US005692450A

United States Patent [19]

Alter et al.

[11] Patent Number: 5,692,450

[45] Date of Patent: Dec. 2, 1997

[54] ONE MAN FISHING VESSEL

[76] Inventors: Hobart L. Alter, 5386 Pole Pass, Deer Harbor Rd., Deer Harbor, Wash. 98243; Jeffrey L. Alter, 14100 Pioneer Rd., McCall, Id. 83638

[21] Appl. No.: 526,969

[22] Filed: Sep. 12, 1995

[51] Int. Cl.[6] ..... B63B 1/00

[52] U.S. Cl. ..... 114/61; 114/351; 114/354; 114/363; 114/255

[58] Field of Search ..... 114/347, 351, 114/352, 353, 354, 357, 61, 363, 123, 283, 292, 255; 441/35, 38; 440/104, 106

[56] References Cited

U.S. PATENT DOCUMENTS

| | | | |
|---|---|---|---|
| 2,747,204 | 5/1956 | Erickson et al. | 114/351 |
| 3,083,382 | 4/1963 | Havens et al. . | |
| 3,117,327 | 1/1964 | Mathew . | |
| 3,593,684 | 7/1971 | Cogliano . | |
| 3,986,219 | 10/1976 | Michowski . | |
| 4,115,888 | 9/1978 | Sievers . | |
| 4,229,858 | 10/1980 | Baxter et al. . | |
| 4,315,475 | 2/1982 | Echols . | |
| 4,388,774 | 6/1983 | Thoemke | 114/255 |
| 4,480,568 | 11/1984 | Trefethern et al. . | |
| 4,493,285 | 1/1985 | Williams . | |
| 4,496,325 | 1/1985 | Tweg . | |
| 4,698,034 | 10/1987 | Anthonijsz . | |
| 4,700,648 | 10/1987 | Trefethern et al. . | |
| 4,827,859 | 5/1989 | Powell . | |
| 4,836,298 | 6/1989 | Laboureau | 114/352 |
| 4,856,446 | 8/1989 | Herard . | |
| 4,919,632 | 4/1990 | Smith et al. . | |
| 5,042,411 | 8/1991 | Krolczyk . | |
| 5,074,233 | 12/1991 | Weed . | |
| 5,189,974 | 3/1993 | Masters | 114/61 |
| 5,217,400 | 6/1993 | Creek et al. . | |
| 5,290,196 | 3/1994 | Steel . | |
| 5,297,978 | 3/1994 | Ramsey . | |

FOREIGN PATENT DOCUMENTS

| | | | |
|---|---|---|---|
| 1792870 | 2/1993 | U.S.S.R. | 114/352 |

OTHER PUBLICATIONS

Advertisement for Buck's Bags in magazine "Fly Tackle Dealer", vol. 15/No. 1, Show 1994, p. 61.

*Primary Examiner*—Stephen Avila
*Attorney, Agent, or Firm*—Holland & Hart LLP

[57] ABSTRACT

A one-man vessel ideally suited for fishing includes a pair of rigid support pontoons that are interconnected by cross-frame members to provide a solid base from which a number of accessory components are mounted. A seat with a foldable back is supported on the cross frame members along with a stripping apron having storage pouches and a work table surface. Oar locks, fishing pole supports, fish finders and other accessory items are easily attached along the outer side of the pontoons while a cooler can be supported from the seat back for ready access by an operator. A storage rack is also provided between the pontoons for retaining and supporting additional fishing gear or the like that might be desired on the vessel.

20 Claims, 14 Drawing Sheets

60
198
192
110
157
4A
150
138
148
146
113
156
54
438
436
84
86
58
286
9
64
68
140
170
56
142
200
144
162
168
164
154
160
166
152
158
62

ONE MAN FISHING VESSEL

BACKGROUND OF THE INVENTION

1. Field of the Invention

The present invention relates generally to pontoon type vessels and, more specifically, to a versatile one-man fishing vessel structured to accommodate various accessory items important to fishing.

2. Description of the Known Art

Fishing dates back to antiquity and in early times it was a means of survival more than a sport. In recent years, however, advanced technology and affluency have made fishing a great pastime, both as a source of food, but probably more as a sport.

Fishing takes on many forms, such as fly fishing, deep sea fishing, lake fishing, and the like. Fisherman either walk in shallow waters such as in streams and smaller rivers, fish from along the shores of bodies of water or from boats that range from small rowboats to large and elaborate ocean classified vessels.

Since fishing is primarily an individual sport, more recently vessels have been developed for accommodating a single person and are adapted for use on lakes or other similar bodies of water where such vessels are appropriate. Examples of vessels or flotation devices suitable for such purposes are disclosed in U.S. Pat. No. 5,217,400 issued to Creek, et al., U.S. Pat. No. 5,290,196 issued to Steel and U.S. Pat. No. 4,919,632 issued to Smith, et al.

The Smith, et al. raft is of a simple pontoon type having a bench seat while being convertible for easy transportation in backpack fashion.

The inflated float device disclosed in the Steel patent is similar except that it has a seat with a foldable back and is of further interest in providing auxiliary support straps for carrying additional items or equipment when the device is in the water. The device is operated by a fisherman sitting in the seat while wearing fins on his feet. The seat is suspended above water level such that the fisherman's feet can hang into the water so that by kicking the feet the fisherman can manipulate the device as desired.

The Creek, et al. Patent discloses a more sophisticated personal floatation device having a U-shaped floatation tube assembly which supports a seating platform and storage pouches. The U-shaped floatation tube is inflatable, and therefore, when one is seated on the bench type seat which spans two legs of the floatation tube, the legs are urged toward each other. To prevent a collapsing of the legs toward each other, a tensioning strap is provided around the perimeter of the tube.

One major drawback with floatation devices of the type noted in the prior art is that the basic construction of the device does not provide for easy attachment of various accessory items which are important to fishing, and therefore, a user of the devices does not have the convenience that is either desired or required for a satisfactory fishing experience. By way of example, the afore-noted prior art floatation devices do not provide for oars which enable a fisherman to move more rapidly from one location to another while in the water, nor do they provide for such items as coolers, fishing rod holders, and the like. While the Steel device does provide a screen-type table or platform bridging the two pontoons of the device, the table is not easily removable and redeployable and therefore is less than desired from a convenience standpoint.

It is to overcome the shortcomings in the prior art and to provide a new and improved one-man floatation device that is readily adapted for accommodating and providing various fishing accessory items that the present invention has been developed.

SUMMARY OF THE INVENTION

The floatation device or fishing vessel of the present invention is of the pontoon type having a pair of rigid pontoons which are retained in fixed spaced and parallel relationship by cross-frame members to form a rigid base on which numerous other items can be supported. The cross-frame members are connected to the pontoons by quick-release fasteners. The base for the vessel is, therefore, easily assembled and disassembled by the quick connection or disconnection of the cross-frame members to and from the pontoons.

The cross-frame members form a base of support for a seat having a flexible bottom and a foldable back which enables a fisherman to be comfortably seated on the vessel. A stripping apron is pivotally supported on the seat for movement between a use position wherein it is horizontally deployed in front of the fisherman at the fisherman's waist level and a raised non-use position wherein it is pivoted over the user's head so as to be positioned rearwardly of the user. The stripping apron is supported along lateral edges by vertical supports which are releasably connected to the cross-frame members adjacent each pontoon, and further includes a pair of storage bags which are easily accessed by the user of the vessel.

A storage cooler is supported on the seat back and in a position where the user of the device can easily access the cooler. The pontoons each have pre-formed accessory-mounting locations in the form of cylindrical recesses adapted to releasably retain any one of numerous accessories such as a fishing rod holder, extra storage bags, a fish finder, or oar locks that removably support oars. The cross-frame members are further adapted to support a foot rest against which the user of the vessel can brace his feet when rowing the vessel.

The cross-frame members also form the base of support for a backpack system which includes padded backpack straps and a waist belt that enables a user to easily transport the vessel in backpack fashion.

The pontoons are also provided with inwardly directed recesses for supporting storage rack bars which cooperate with one of the cross-frame members for storing additional items.

Other aspects, features and details of the present invention can be more completely understood by reference to the following detailed description of a preferred embodiment taken in conjunction with the drawings, and from the appended claims.

DESCRIPTION OF THE PREFERRED EMBODIMENT

Figure 1:
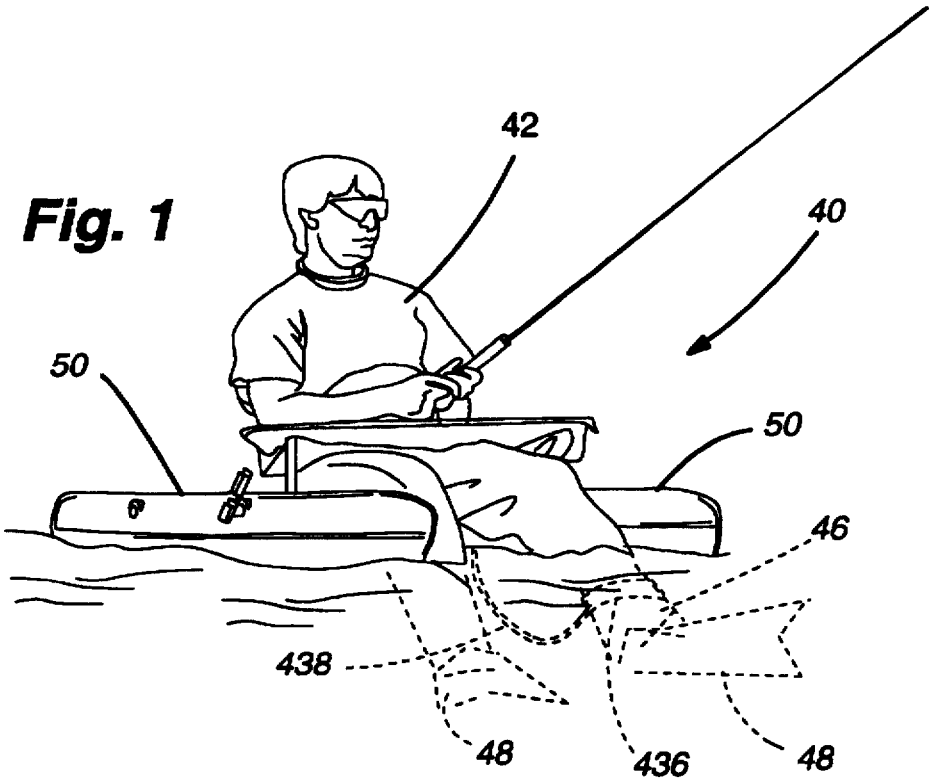
FIG. 1 is a diagrammatic isometric of a fisherman utilizing the vessel of the present invention.

The one-man fishing vessel 40 of the present invention is adapted for use by a fisherman 42 as illustrated in FIG. 1. For purposes of the present disclosure, the vessel 40 will be described as though the fisherman faces the rear 44 of the vessel 40 since the vessel is powered by the fisherman 42 kicking his feet 46 with swimming fins 48 so that the vessel 40 moves forwardly in a direction opposite to that which the fisherman is facing.

Figure 2:
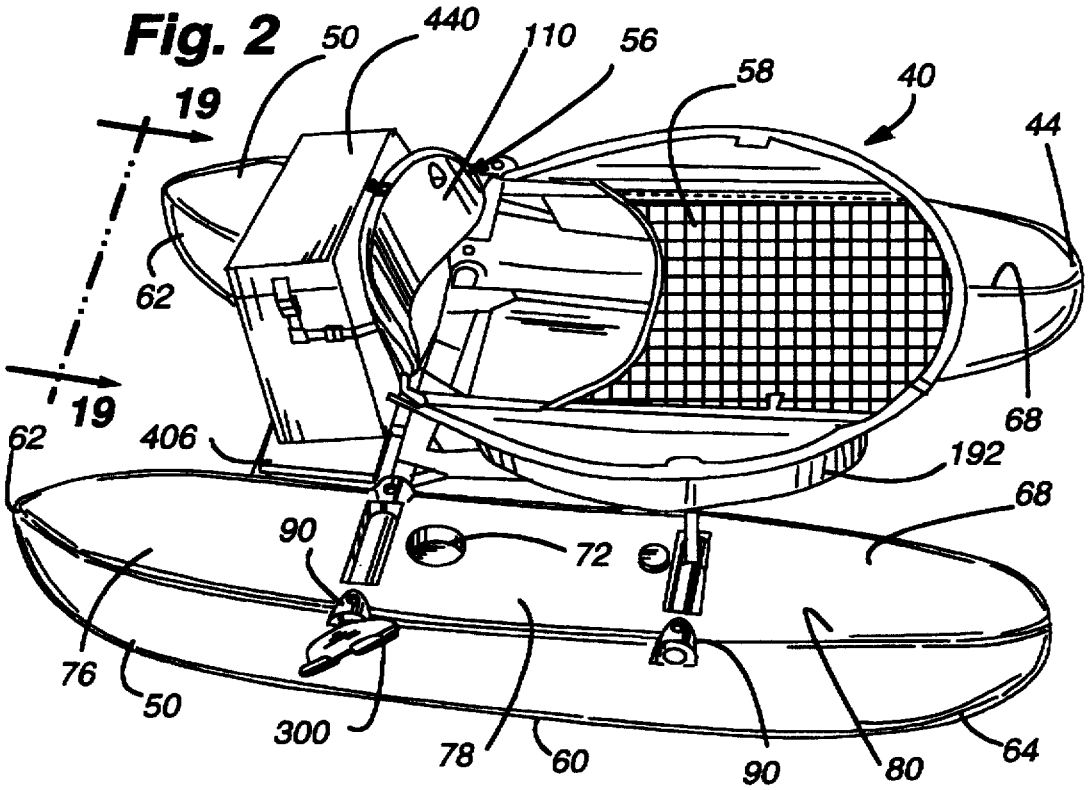
FIG. 2 is an isometric looking down on the vessel of FIG. 1.
Figure 3:
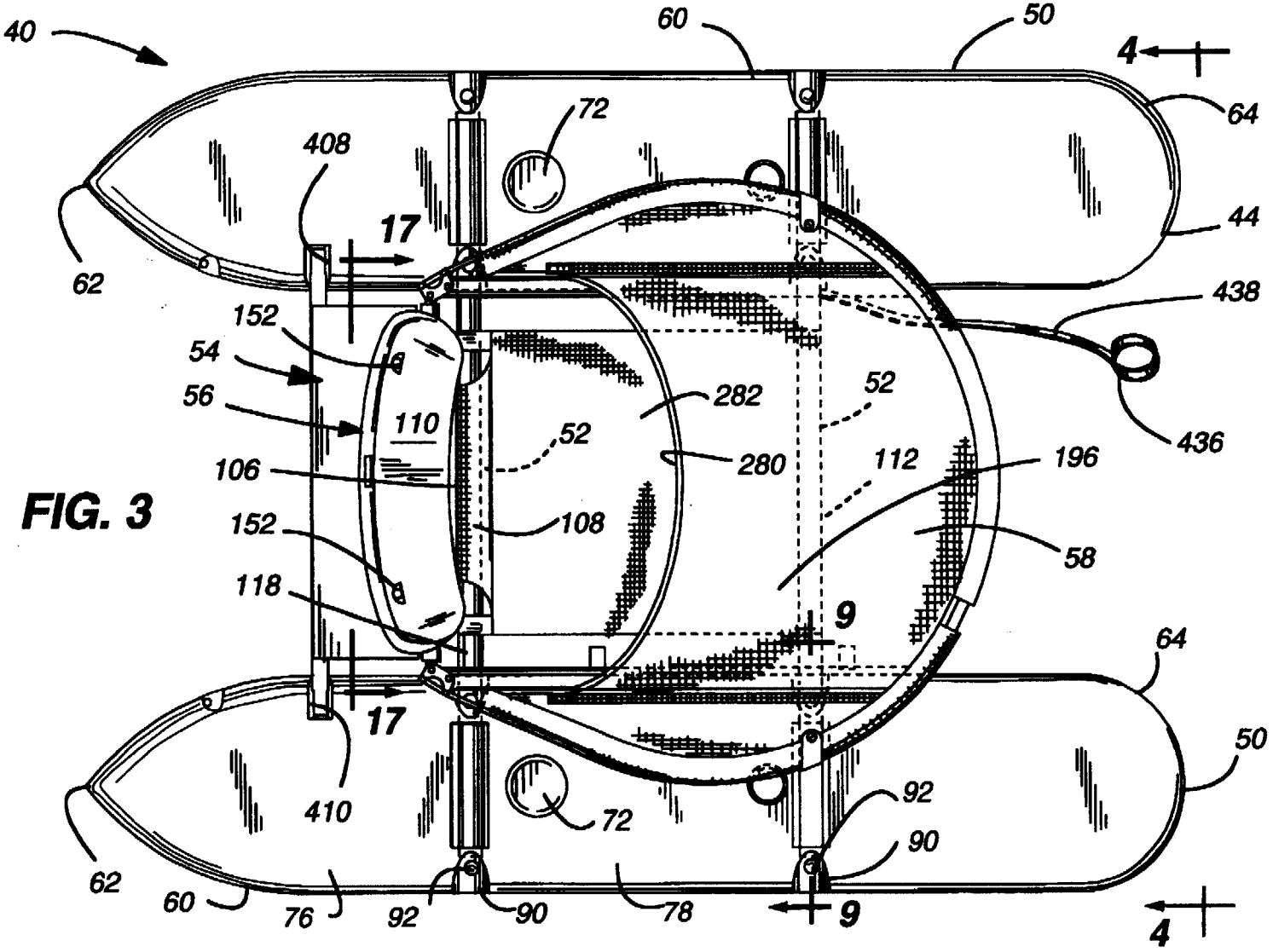
FIG. 3 is an enlarged plan view of the vessel of FIG. 1.

As best seen in FIGS. 2 and 3, the fishing vessel 40 includes a pair of rigid pontoons 50 which are retained in fixed space relationship by a pair of cross-frame members 52 that in combination with the pontoons form a base structure 54 for the vessel 40. A seat assembly 56 is supported on the base structure 54, along with a stripping apron which is pivotally mounted on the seat assembly 56, as well as numerous accessory items.

Continuing with FIGS. 2 and 3, the pontoons 50 are elongated hollow hulls 60 made of polyethylene and are seamless so as to be rigid and resistant to damage such as might be encountered by engagement with rocks or other such material found in various bodies of water. Each pontoon 50 has a tapered front end 62, a rounded trailing end 64 and has a single vent hole 66 in a top wall 68 that is normally sealed with a rubber cap 70 (as shown). The cap 70 can be removed to release air pressure that might build up in the pontoon 50 in unusually hot circumstances. Otherwise, the vent hole 66 is sealed to prevent the ingress of water during use of the vessel 40. A cup sized recess 72 is also provided in the relatively flat top wall 68 of each pontoon at approximately its longitudinal center to selectively accommodate a beverage container used by a user of the vessel 40.

Referring to FIGS. 2, 3, 6A and 6B, each pontoon 50 has a pair of rectangularly shaped recesses 74 formed in the top wall with the recesses extending transversely of the pontoon and dividing the pontoon into front 76, middle 78 and back 80 substantially equal-sized segments. Each recess 74 has communicating therewith laterally directed cylindrical passages 82 opening through an inner side wall 84 and an outer side wall 86 of the pontoon 50. The passages 82 cooperate with an associated recess 74 in defining a pair of continuous, parallel channels 88 through each pontoon 50. The channels open through the top wall 68 of the pontoon 50 at the recess 74 locations. The cylindrical passages 82 laterally of the recesses 74 are formed in cylindrical protrusions 90 on either side of the pontoon 50 with each protrusion 90 having a vertical opening 92 that communicates with the cylindrical passage 82 for a purpose to be described later.

The cross-frame members 52 are elongated rigid tubular members 94 defining opposing ends 96 which can be made of aluminum, light-weight steel or plastic and serve to retain the pontoons 50 in parallel spaced relationship. Each cross-frame member 52 is identical and a cylindrical tube in configuration. Each cross-frame member 52 includes at a location spaced inwardly from each end 96 of the tube, as possibly best seen in FIGS. 6 and 9, a spring biased depressible button 98 that protrudes outwardly through an opening 100 provided in the cylindrical wall 102 of the cross-frame member 52. The diameter of the button 98 is slightly smaller than the openings 92 in the cylindrical protrusions 90 on the sides of each pontoon 50.

The cross-frame members 52 are connected to the pontoons 50 by inserting the ends 96 of the cross-frame members 52 into associated passages on the inner side walls 84 of the pontoons 50 and advancing the ends of the cross-frame member 52 through the passages 82 and into the rectangular recesses 74 until the ends 96 of the cross-frame members 52 are partially received in the passages 82 that open through the outer side walls 86 of the pontoons 50. The depressible button 98 prevents further axial movement of the cross-frame member 52 in the passage 82 of the pontoon 50. However, by depressing the button 98, the cross-frame member 52 can be further advanced into the passages 82 in the outer side walls of the pontoon 50 until the button 98 aligns with the opening 92 in the top of the cylindrical protrusion 90 at which point the button 98 will automatically snap into the opening 92 due to the bias placed on the button 98 by the spring bias means 104, such as a leaf spring (as shown) or coil spring. The depressible buttons 98 thereby securely but releasably connect the ends 96 of the cross-frame members 52 to the pontoons 50. This connection is established at each end 96 of both cross-frame members 52, thereby establishing four locations of connection. A rigid rectangular framework 106 is therefore defined by the two pontoons 50 and the two connected cross-frame members 52.

It is important to realize that the ends 96 of the cross-frame members 52 extend only partially into the cylindrical passages 82 in the outer side walls 86 of the pontoons 50 and, in fact, do not block the opening into the passage 82 from the outer side walls 86, thereby leaving the passages in the outer walls 86 open for a short distance which is important as these passages 82 are utilized in a manner to be described later for mounting accessory items to the pontoons 50.

The seat assembly 56 is probably best seen in FIGS. 2, 3, 4, 5, 6A, 7 and 8, to include a seat bottom and a seat back 110. The seat bottom 108 is preferably made of a rectangular strip 114 of nylon mesh material or the like. It is wrapped around the rear cross-frame member 112, defining upper and lower layers 113 and 115, between the pontoons 50 with the two ends 116 of the rectangular strip 114 then extending forwardly so that the upper layer 113 of the strip 114 can be wrapped around the front cross-frame member 118 and joined to the opposite end 116 of the strip 114 beneath the front cross-frame member 118. The two ends 116 of the strip 114 can be joined in any suitable manner such as, for example, by lacing the two ends together through grommets 120 provided along each end of the strip 114.

Figure 6A:
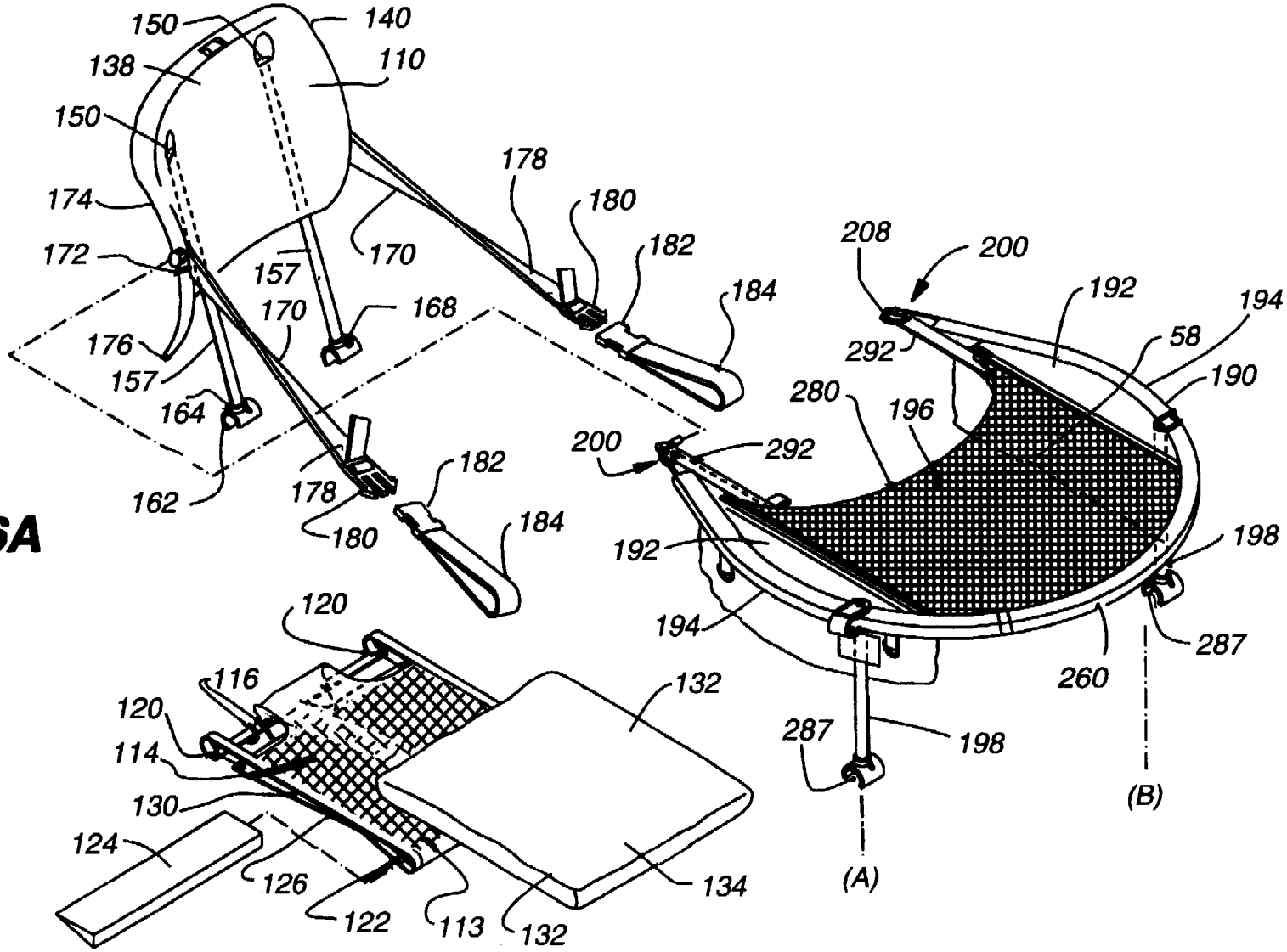
FIG. 6A is a partial exploded isometric of the vessel of FIG. 1.
Figure 6B:
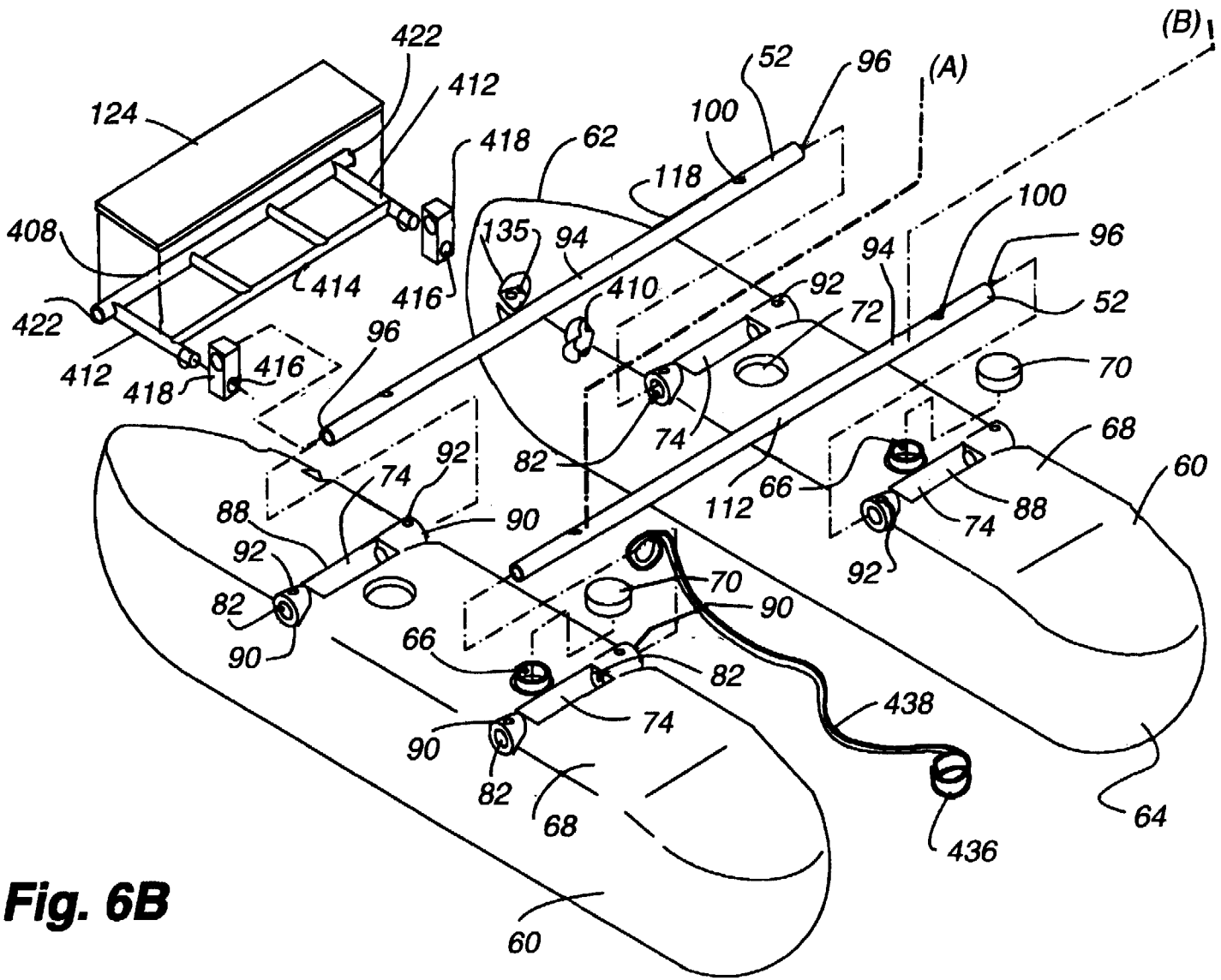
FIG. 6B is a partial exploded isometric of the vessel of FIG. 1, and is complimentary to FIG. 6A.
Figure 8:
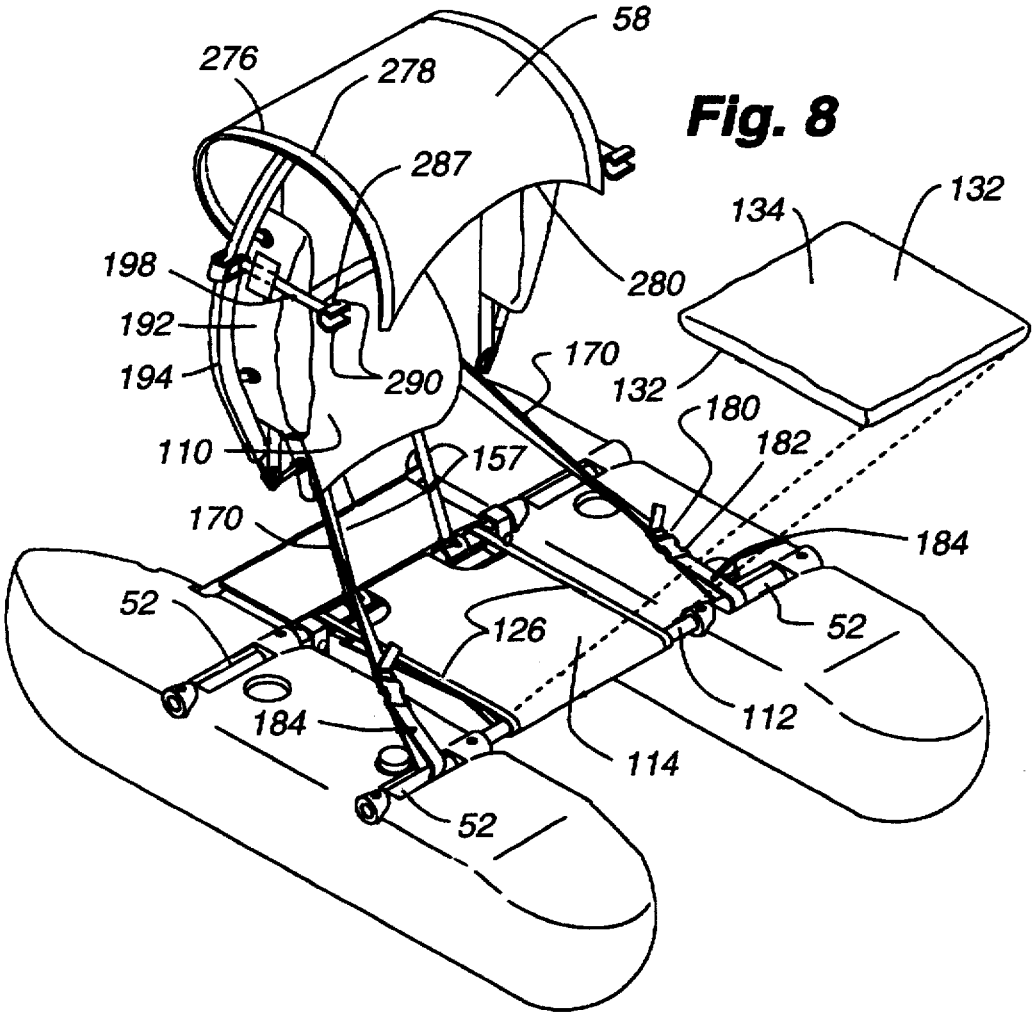
FIG. 8 is an isometric similar to FIG. 7 showing the stripping apron folded forwardly.

It should be noted as best seen in FIGS. 6A and 8, that the upper layer 113 of the strip 114 is notched along both sides near the front cross-frame member 118 to expose the cross-frame member 118 along each side of the strip. A pocket 122 is defined between the upper 113 and lower 115 layers of the strip 114 adjacent the rear cross-frame member 112 by stitching the layers 113, 115 together along a transverse line. A foam pad 124 or the like can be placed in the pocket 122 to cushion the user's legs as they extend over the rear cross-frame member 112. In addition, strips 126 of Velcro® are provided along the top of the lateral edges 130 of the top layer 113 of the strip 114 and are adapted to mate with and be releasably secured to the side edges 132 of a large cushion 134 which is disposed over the strip 114 to provide a more comfortable base upon which the operator can sit.

The seat back 110 is a molded plastic panel 138 having a contoured rearwardly facing surface 140 for engagement with a user's back, and a recessed front surface 142 surrounded by a peripheral flange 144 that faces the front of the vessel 40. The back seat panel 138 is best seen in FIGS. 2, 3, 4, 4A, 5, 6A, 7, and 8, and it will be appreciated that a pair of recessed openings 146 are provided at laterally spaced locations adjacent the top edge 148 of the seat back 110 that define horizontal shoulders 150 having openings 152 therethrough. The openings are vertically aligned with a pair of openings 154 through a bottom segment 156 of the peripheral flange 144 thereby defining two pair of vertically aligned openings 152, 154. The openings 154 in the bottom segment of the flange 144 receive vertical support posts 157 for the seat back 110.

Figures 4, 4A, 5:
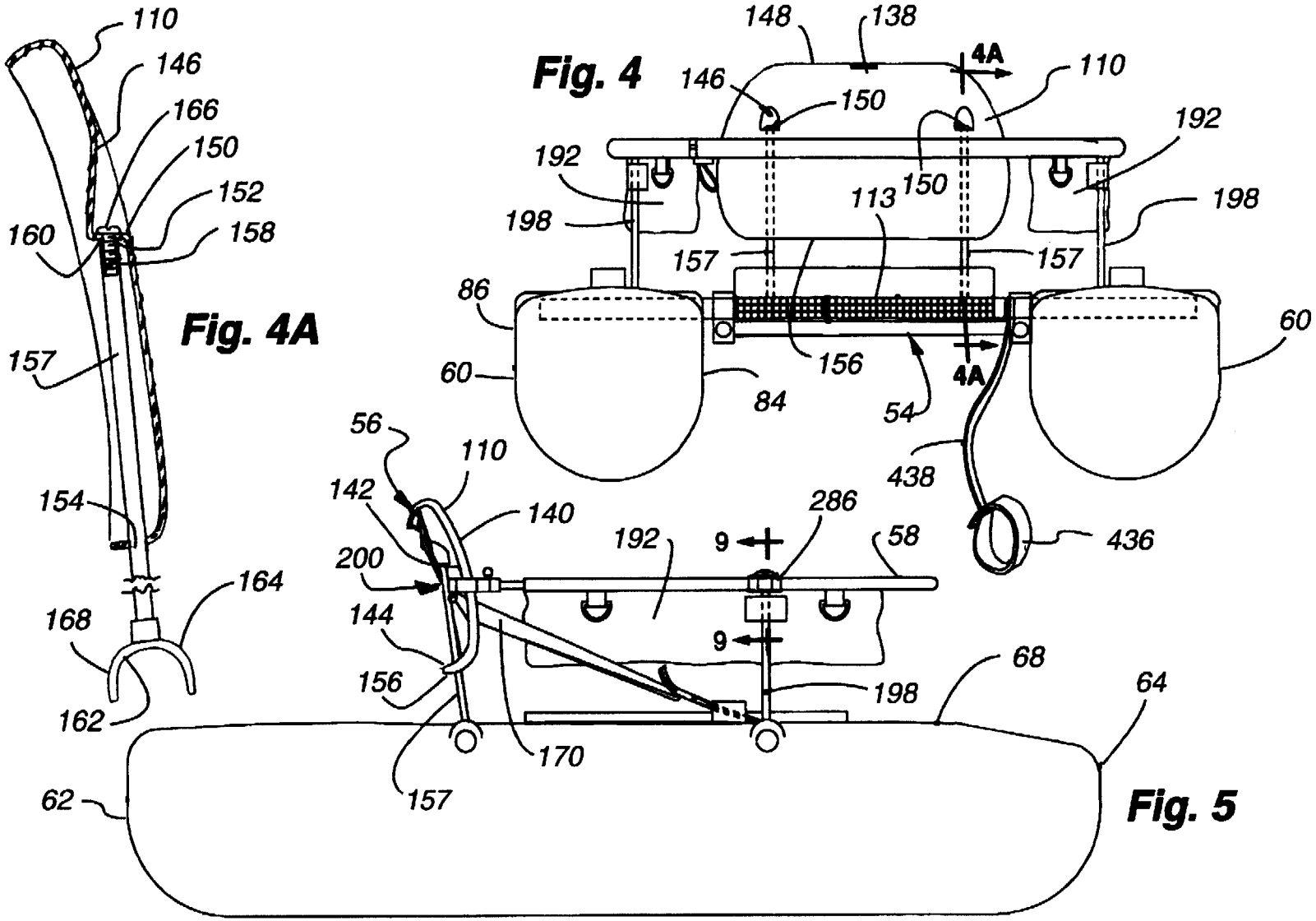
FIG. 4 is a rear elevation of the vessel of FIG. 1.
FIG. 4A is a section view taken along lines 4A—4A in FIG. 4.
FIG. 5 is a left side elevation of the vessel of FIG. 1.

The vertical support posts 157 can be aluminum rods or other lightweight rigid rods having an internally threaded recess 158 in their upper end 160 and laterally directed open channels 162 on their lower end 164, as shown in FIG. 4A. The posts 157 are adapted to be extended upwardly through the openings 154 in the bottom segment 156 of the flange 144 and abut against the under surface 166 of the shoulder 150 so that a threaded screw-type fastener 166 can extend downwardly through the hole 152 in the shoulder 150 into threaded engagement with the post 157 to secure the post 157 to the seat back 110.

The laterally directed channels 162 at the lower ends 164 of the support posts 157 define arcuate arms 168 that extend slightly more than 180 degrees around the channel 162. The arcuate arms 168 are made of a resilient spring-like material so that they can be snapped onto or off of the front cross-frame member 118 in the exposed area of the cross-frame member 118 adjacent each side 130 of the strip 114. As will be appreciated, the channels 162 thereby establish a pivotal connection between the seat back 110 and the front cross-frame member 118 so that the seat back 110 can be pivoted forwardly or rearwardly.

Rearward pivotal movement of the seat back 110 is limited. An elongated web or strap 170 that passes through slots 172 in side segments 174 of the peripheral flange 144 of the seat back 110 adjacent a lower edge 176 thereof and extend across the front surface 142 of the seat back 110 with the terminal ends 178 of the elongated strap 170 having male connectors 180. The male connectors 180 are adapted to be releasably connected to female connectors 182 on short straps 184 that pass around and are anchored to the rear cross-frame member 112 within the associated rectangular recess 74. The elongated strap 170 is adjustable in length at its connection to one or both of the two male connectors 180 thereby providing a system for adjusting the tilt of the seat back 110 dependent upon the desires of a user.

Figure 17:
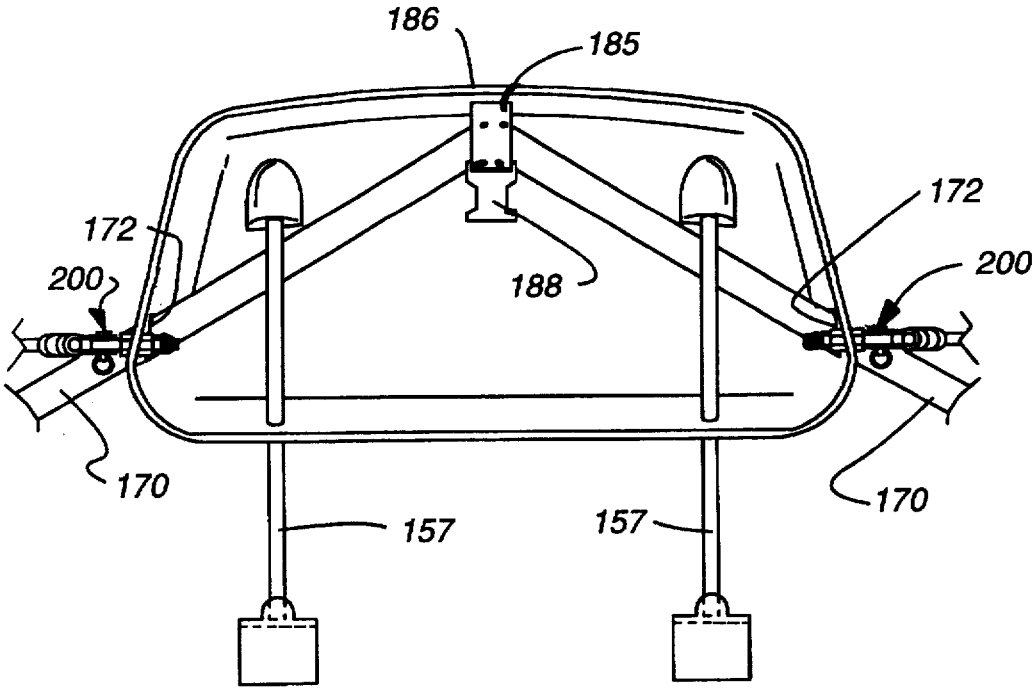
FIG. 17 is an enlarged fragmentary view taken along line 17—17 of FIG. 3.

As best seen in FIG. 17, as the elongated strap 170 passes around the recessed front surface 142 of the seat back 110, it is extended through a short piece of looped strapping material 185 that is suspended from an upper segment 186 of the peripheral flange 144, thereby positively positioning the elongated strap 170 across the recessed front surface 142 of the seat back 110. The short loop 184 of strapping material 185 has a female connector 188 thereon for a purpose to be described later.

The stripping apron 58, as seen in FIGS. 2, 3, 6A, 7, and 8, serves a number of useful functions, such as, for stripping fishing line when fly fishing, or even as a tabletop-type surface for general use. The stripping apron 58 includes an generally ovular shaped support frame, 190 a pair of storage pouches 192 along opposite lateral sides 194 of the frame 190, a table section 196, support posts 198 and connective brackets 200 for pivotally securing the stripping apron 58 to the seat back 110.

The ovular frame 190 is a two piece tubular frame 202 made of fiberglass, aluminum or other material which can be bent or otherwise formed into the generally ovular configuration. In the preferred embodiment, one of the tubular frame members 202 is slightly longer than the other and each have one end 204 that is connectable to a bracket 200 at a front end 208 of the frame 190, as shown in FIG. 18, and another end 210 that is connectable to the other frame member, as shown in FIG. 10.

Figure 10:
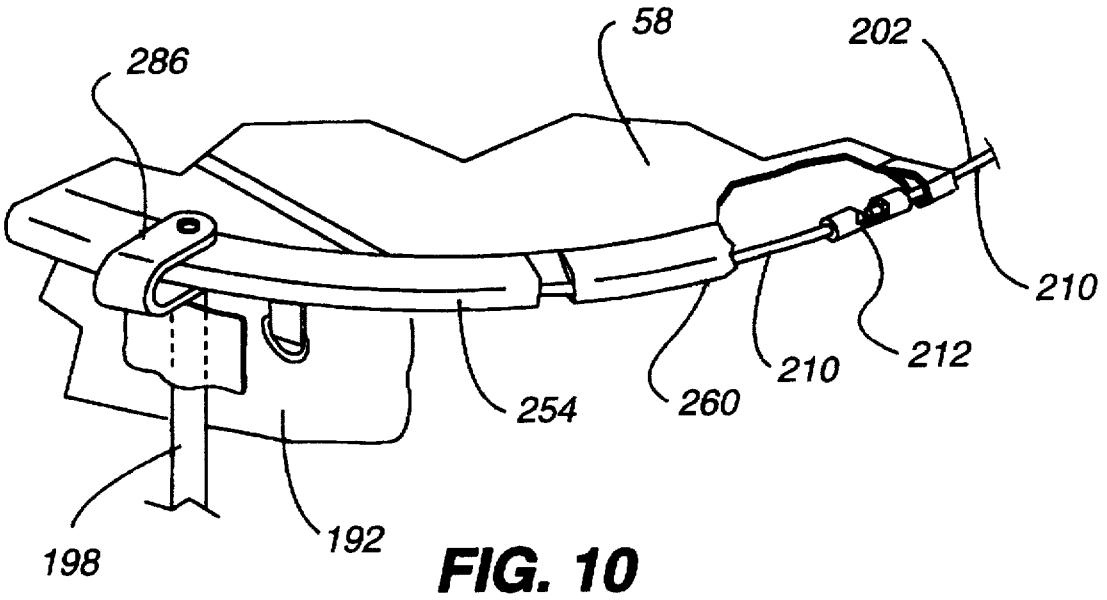
FIG. 10 is a fragmentary isometric with parts removed for clarity of a rear portion of the stripping apron of the vessel.
Figure 18:
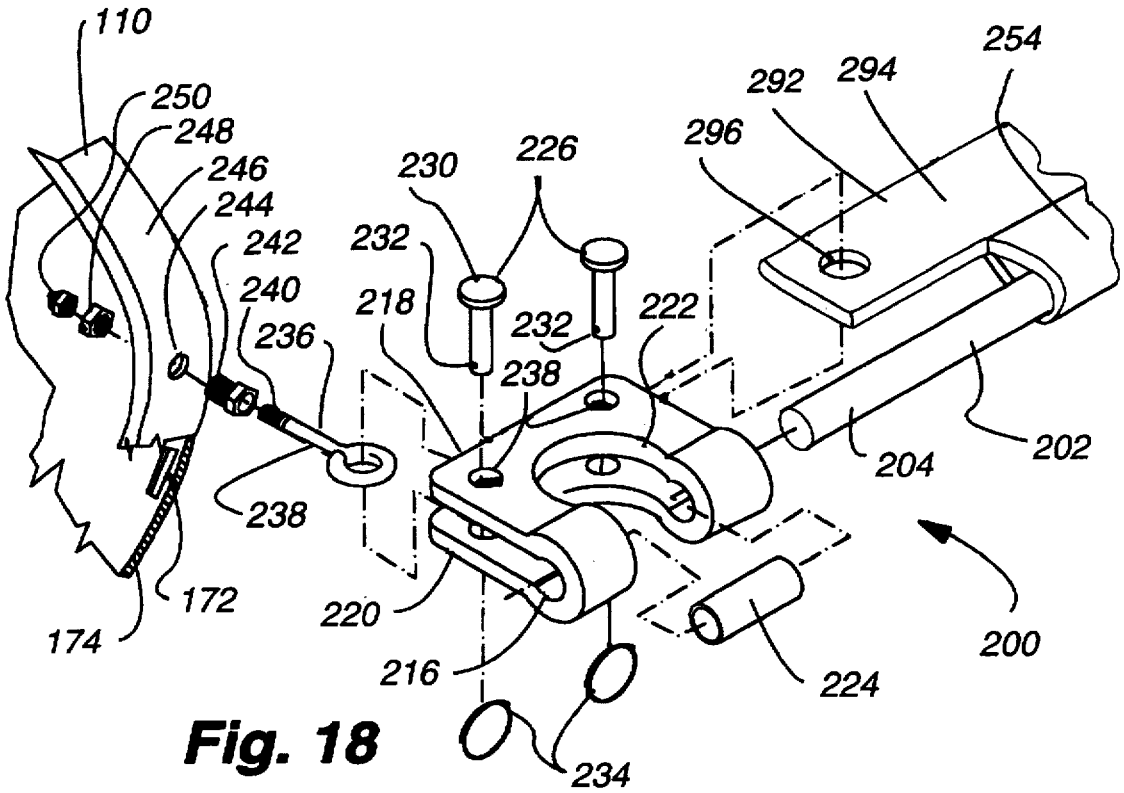
FIG. 18 is an exploded fragmentary isometric showing the bracketed interconnection between the stripping apron and the seat back.

The connectable ends 210 of the frame members 202 have conventional threaded connectors 212 thereon so that they can be releasably connected, as shown in FIG. 10, while the opposite end 204, as best seen in FIG. 18, is unencumbered for attachment to a bracket 200.

Continuing with FIG. 18, each bracket 200 is identical having been formed from a strip of metal that is bent around a rod of the same diameter as the frame element 202 so as to define a cylindrical passage 216 adapted to receive the end 204 of a frame member 202. The bracket 200 has spaced upper 218 and lower 220 plate portions and a notch 222 provided through the cylindrical passage 216 and each plate portion 218, 220. To connect the bracket 200 to the associated end 204 of a frame member 202, the frame member 202 is partially inserted into the passage 216 and a deformable metal sleeve 224 is aligned with the passage 216 in the notch 222 so that the end 204 of the frame member 202 can then be further inserted through the sleeve 224 and the remainder of the passage 216 so that the bracket 200 is fully seated upon the end 204 of the frame member 202. The deformable sleeve 224 is then crimped onto the frame member 202 so as to prevent the bracket 200 from sliding off the end 204 of the frame member 202.

Connector pins 226 are provided to extend through aligned openings 228 in each plate portion 218, 220 of the bracket for purposes to be described later. Each connector pin 226 has a head 230 on one end and a transverse passage 232 through its other end adapted to receive a retainer ring 234 which secures the pin 226 in the associated opening 228 and prevents the bracket 200 from being spread which might otherwise release the bracket 200 from the end 204 of the frame member 202. Before the pins 226 are inserted through the openings 228 in the bracket 200, however, an I-bolt 236 is aligned with one of the pins 226 on each bracket 200 so as to be captured between the plate portions 218, 220 of the bracket 200. The I-bolt 236 has an unthreaded shank 238 and a threaded end 240 so that it can be extended through an externally threaded bushing 242 seated in an opening 244 in a side segment 246 of the peripheral flange 144 of the seat back 110 and is secured in the bushing 242 by a securement nut 248 and a capped nut 250 threaded onto the end of the I-bolt 236. The I-bolts 236 are pivotal within the bushings 242 and through their connections with the brackets 200 permit the entire frame 190 of the stripping apron 58 to pivot about the I-bolts 236 between a horizontal use and position as shown in FIG. 2 and a retracted non-use position of FIG. 8, where the stripping apron 58 is lifted over a user's head so as to be disposed forwardly of the operator relative to the vessel 40.

Figure 11:
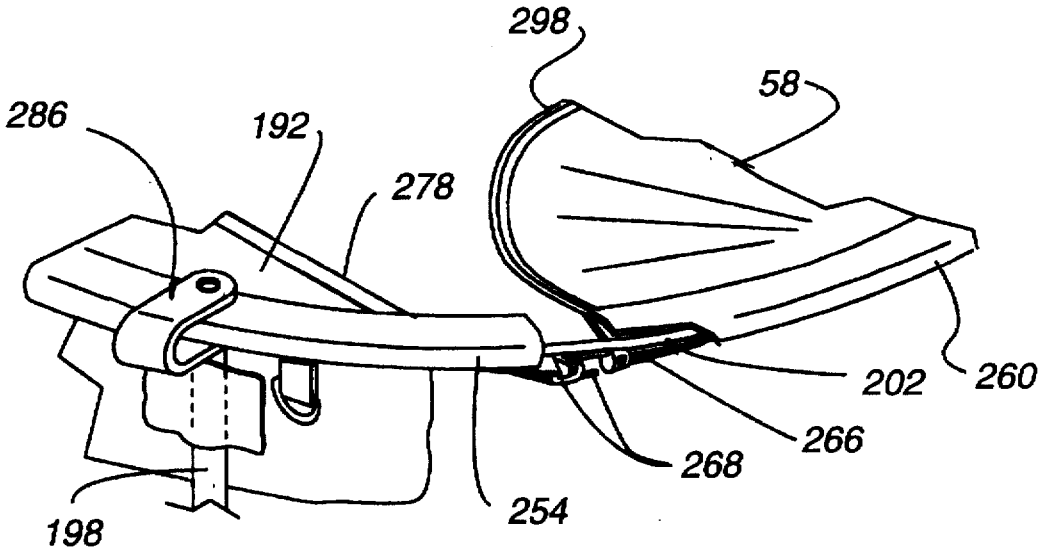
FIG. 11 is a fragmentary isometric similar to FIG. 10 with the table portion of the stripping apron folded rearwardly.

Referring to FIGS. 2, 5, 7, 8, 21, and 26, each storage pouch 192 is positioned adjacent a lateral side 194 of the ovular frame 190 and is secured to the frame 190 by a fabric strip 254 that is sewn along one side edge 256 of the storage pouch 192 in a manner to define a channel 258 through which the frame member 202 extends. The same strip 254 of fabric material associated with one of the storage pouches 192 secures the rearward-most edge 260 of the table portion 196 of the stripping apron 58 to the frame member 190 in a similar manner. The adjacent ends 264 of the support strips 254 can be releasably secured together as with bungee cords 266 and fasteners 268 as best shown in FIG. 11.

Figure 7:
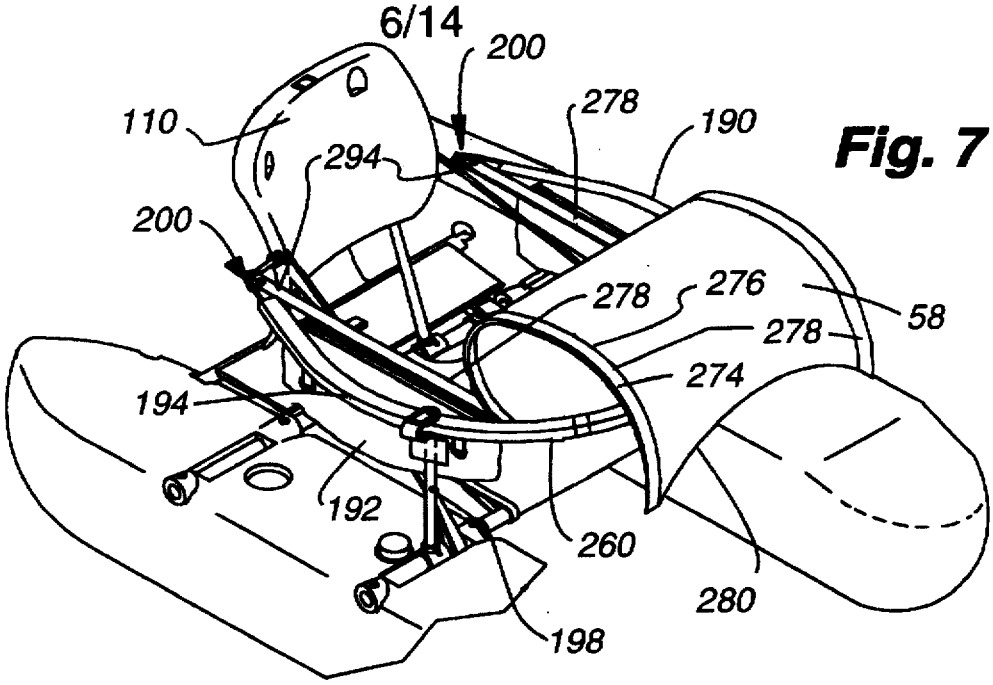
FIG. 7 is a fragmentary isometric looking down on the vessel of FIG. 1 showing the table portion of the stripping apron folded rearwardly.
Figure 26:
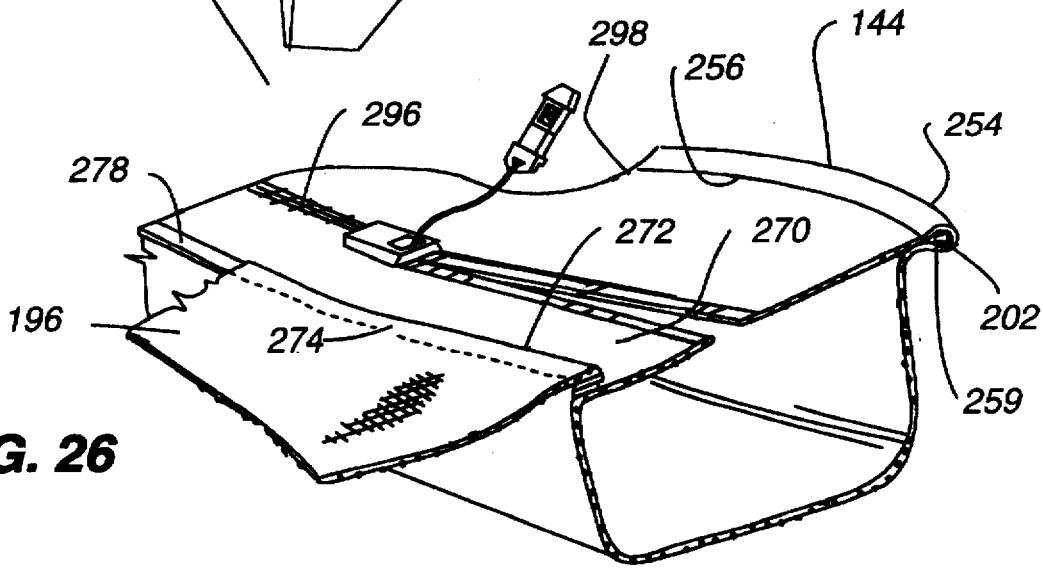
FIG. 26 is an enlarged fragmentary isometric showing the interconnection between the table portion of the stripping apron and storage bags therein.

The inner edges 270 of each storage pouch 192 along a top surface 272 thereof and the lateral side edges 274 of the table portion of the stripping apron 58 along a bottom side 276 thereof are provided with mating fasteners 278 such as of the Velcro® type, as shown in FIG. 26. The table portion 196 is thereby readily moveable between a use position wherein it is connected to the storage pouches 192 as seen in FIG. 2 and an extended position as shown in FIG. 7 where it extends rearwardly of the frame 190 and out of the way of a user of the vessel. The forwardmost edge 280 of the table portion 196 is arcuate in configuration to define an opening 282 in which the user can sit.

Figure 9:
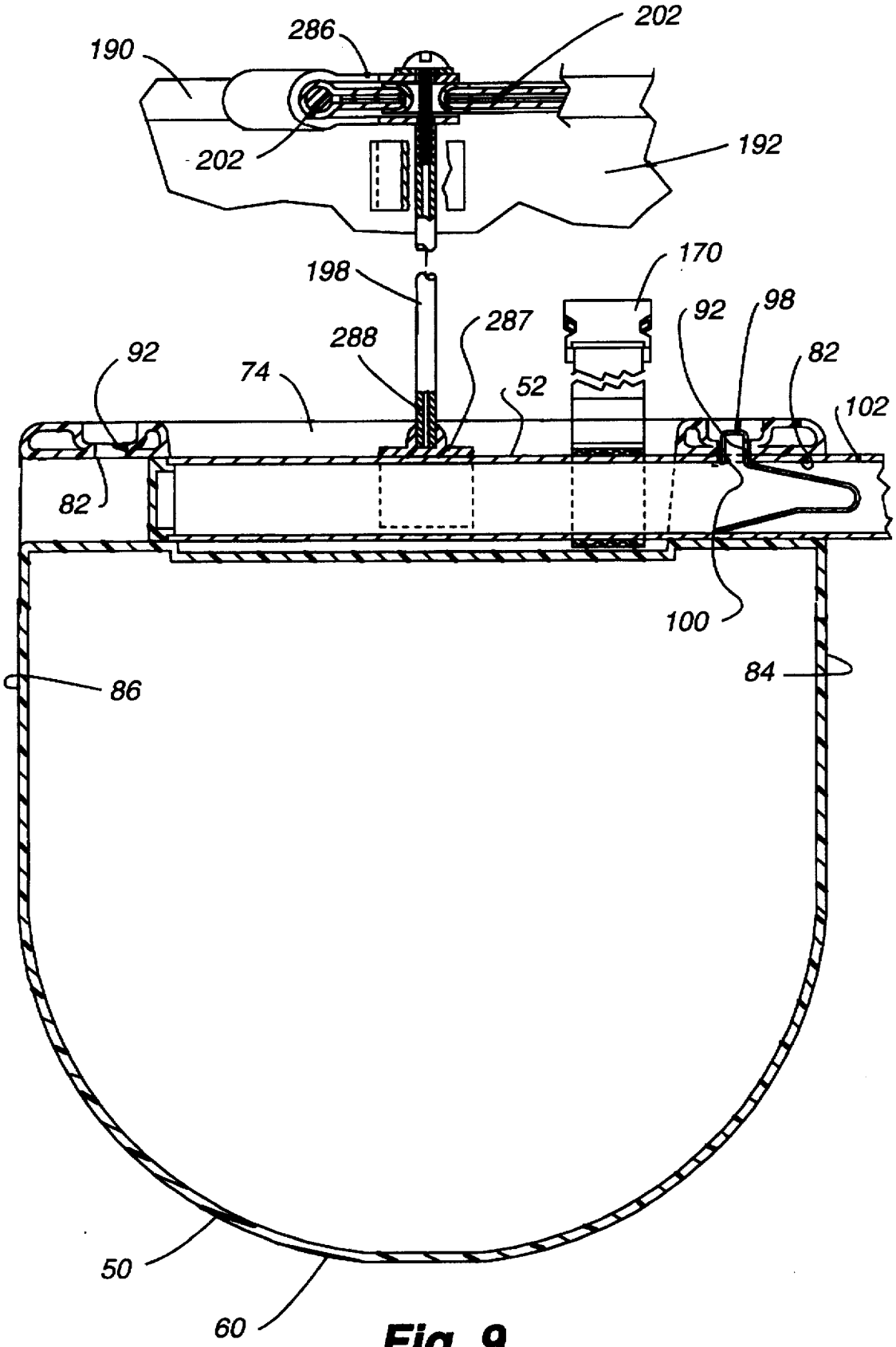
FIG. 9 is an enlarged section taken along line 9—9 of FIG. 3.

Referring to FIG. 9, the frame 190 for the stripping apron is supported at laterally spaced locations by the support posts 198 which might be aluminum or lightweight steel that are connected by a U-shaped bracket 286 at the top to a predetermined location on the ovular frame 190. The support posts 284 each have a laterally extending channel member 286 on its lower end 288. The channel member 286 is substantially cylindrical in configuration so as to define a pair of arcuate legs 290 that extend more than 180 degrees. The channel member 286 is made of a flexible material such as plastic or steel so that it can be easily snapped onto or off of the rear cross-frame member 112 within the associated rectangular recess 74.

Again, referencing FIG. 18, the pin 226 that does not secure the I-bolt 236 to the bracket 200 is adapted to secure one end 292 of the fabric strip 294 that extends along an inner edge 270 of a storage pouch 192 to the bracket 200. The fabric strip 294 has an opening 296 adjacent the end 292 thereof which is alignable with the pin as the pin 226 is being connected to the bracket 200. By anchoring this edge 270 of the storage pouch 192, the storage pouch 192 can be stretched between the bracket 200 and the rear 260 of the frame 190. The pouches 192 are thereby adequately suspended from the frame 190 and in a manner so as to desirably support the table portion 196 when the table portion is secured to the inner edges 270 of the storage pouches 192.

As seen in FIG. 26, each storage pouch 192 has an elongated zipper 296 in a top panel 298 thereof which is immediately adjacent to the table portion 196 of the stripping apron 58 so that easy access to the interior of each storage pouch is available to a user of the vessel 40. The storage pouches 192 can be used for any purpose, by way of example, for storing flies, reels or other accessories that a fisherman might want.

As mentioned previously, the outwardly opening passages 82 on each pontoon 50 are adapted to receive and retain various accessory items. One of those accessory items would be a fishing rod holder 300. The fishing rod holder 300 is best seen in FIGS. 12 through 16 to include a channeled main body 302 and a pivotally interconnected connection tube 304.

Figure 14:
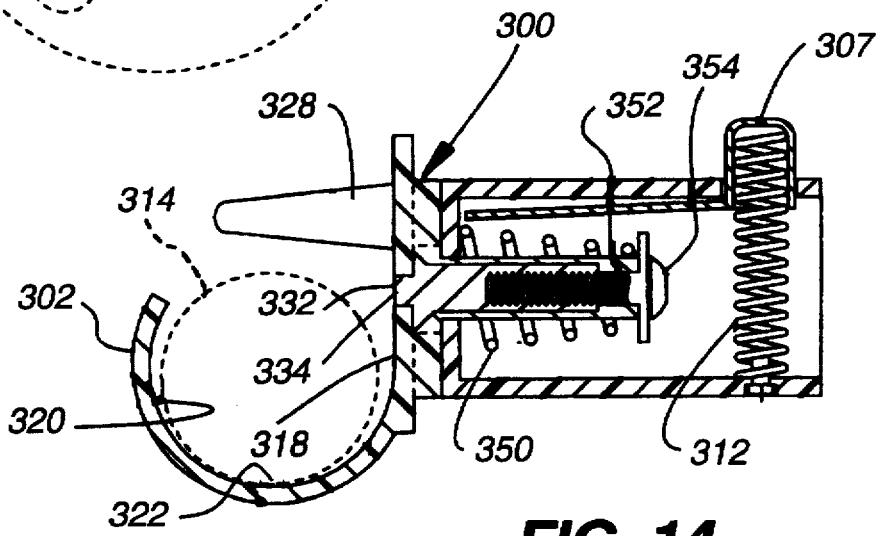
FIG. 14 is a section taken along line 14—14 of FIG. 13.
Figure 15:
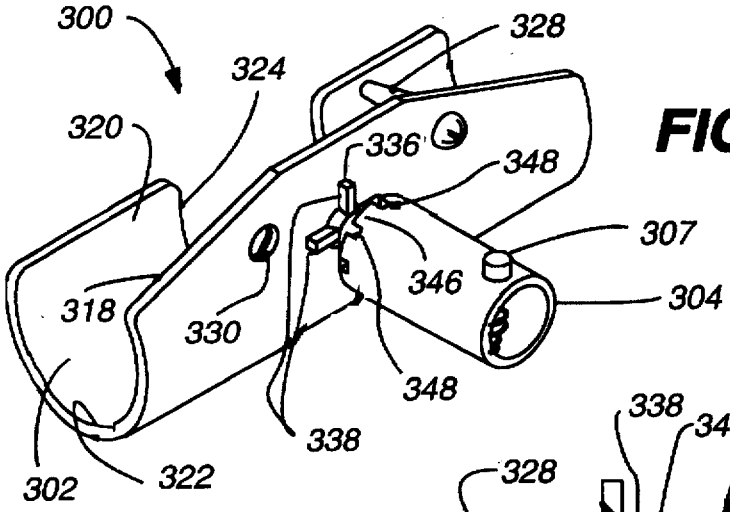
FIG. 15 is an isometric of a rear side of the fishing rod holder in an operative position.

Referring to FIG. 14, the connection tube 304 is of cylindrical configuration having an outer diameter 306 slightly less than the inner diameter 308 of the passage 82 in the pontoon 50 so that the connection tube 304 can be inserted into the passage 82. The connection tube 304 has a spring biased depressible button 307 projecting outwardly through an opening 308 in the cylindrical wall 310 with the button 307 being biased outwardly by a spring bras means 312, such as a coil spring, disposed interiorly of the connection tube 304. The button 307 is depressed to allow the connection tube to be fully inserted into the passage 82 in the pontoon 50, and when the button 307 aligns with the opening 92 in the cylindrical protrusion 90 on the pontoon 50 it will securely snap into the opening 92. The button 306 releasably connects the connection tube 304 with the pontoon 50 with the channel shaped main body 302 of the holder 300 disposed along the side of the pontoon 50.

The channel shaped main body 302 is dimensioned to receive the handle 314 of either a fly-fishing or spin-casting rod 316 (shown generically in dash in FIGS. 12–14, and 16), and has inner 318 and outer 320 plate portions which are interconnected by a curved bottom wall 322. The outer plate portion 320 is notched to define a slot 324 to receive the reel 326 of a fly fishing rod as depicted in phantom line in FIG.

12. The reel 326 depends downwardly from the channel through the slot, and has a dimension larger that of the slot 324. As such, the reel cannot pass through the slot 324. In this way, the fly-fishing rod is secured in the channel.

Figure 12:
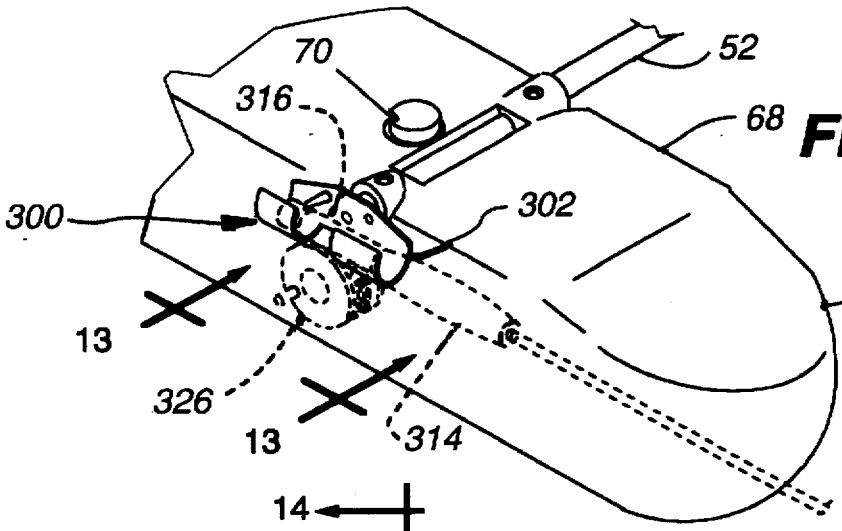
FIG. 12 is a fragmentary section taken through a rear portion of a pontoon showing a fishing rod holder with a portion of a fishing rod supported in the holder illustrated in hidden lines.
Figure 13:
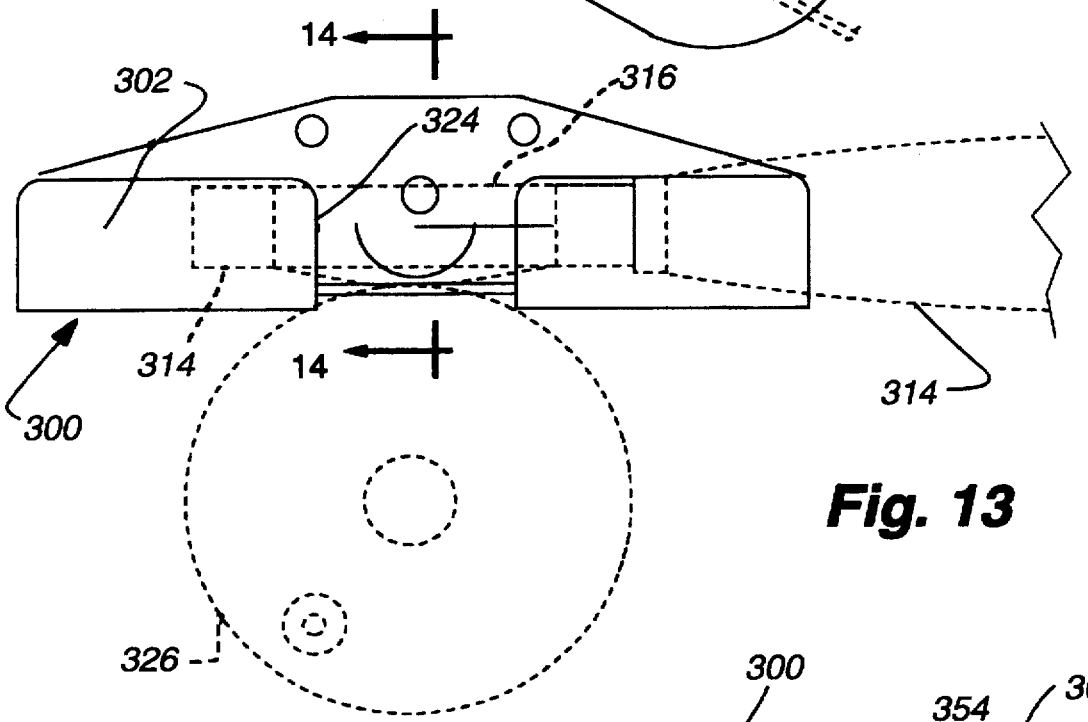
FIG. 13 is an enlarged side elevation of the fishing rod holder shown in FIG. 12 with a portion of a fishing rod shown in hidden lines.

To enable the rod holder 300 to be used with a spin-casting rod, a removable pin 328 is mounted in the inner wall 318 of the channel shaped main body 302 to hold the handle 314 down. Typically, the handle of a spin-casting rod extends behind the spin-casting reel further than the handle extends behind the reel in a fly-fishing rod. The spin-casting reel does not need to extend downwardly through the slot to keep the rod 314 in the rod holder 300. Instead, the pin 328 traps the handle in the channel shaped main body 302 and keeps the handle 314 from tipping out of the channel shaped main body 302 by substantially enclosing the channel shaped main body, as shown in FIG. 14. The pin 328 can be used with a fly-fishing rod, as shown in FIG. 12, but is not necessary, as described above. As will be appreciated, the pin 328 extends through one of two openings 330 in the inner wall 318 so that the fishing rod holder 300 is interchangeable with either side of the vessel 40 to accommodate left and right-handed fishermen.

Figure 16:
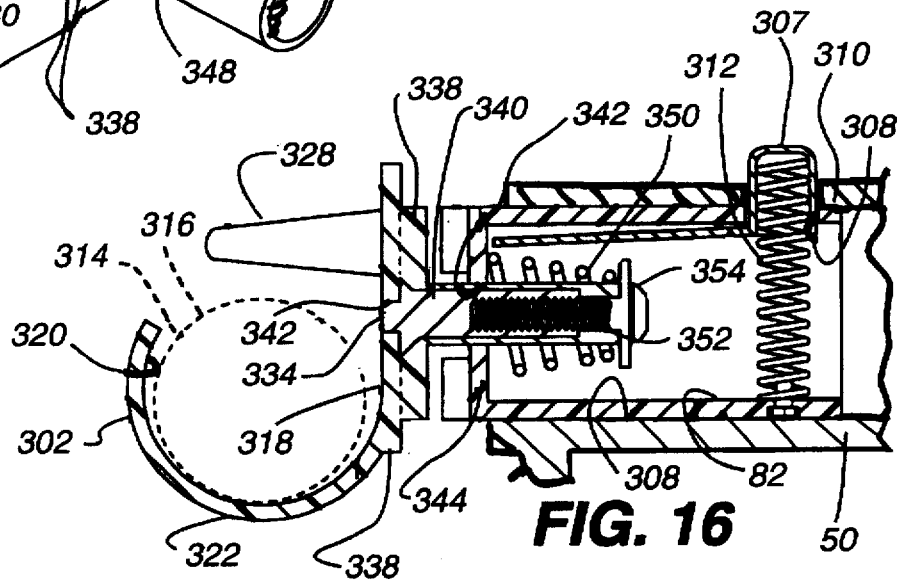
FIG. 16 is a section similar to FIG. 14 showing the fishing rod holder in an operative position for changing the angular orientation of the holder.

Referring to FIGS. 14 and 16, the inner plate 318 portion has another opening 332 that fixedly receives a spindle 334 having a star shaped base 336 with four outwardly directed radial legs 338 and a cylindrical extension 340 that projects into an opening 342 in the outer end 344 of the connection tube 304. The extension 340 is cylindrical in configuration thereby establishing a rotational support for the channel shaped main body 302. The outer end 344 of the connection tube 304 has a plurality of radial teeth 346 establishing slots 348 therebetween adapted to receive the radial legs 338 on the channel shaped main body 302.

The channel shaped 302 main body is resiliently connected to the connection tube 304 by a coil spring 350 received on the end 352 of the cylindrical extension 340 interiorly of the connection tube 304 and retained on the cylindrical extension 340 by a cap screw 354 threaded into the end 352 of the cylindrical extension 340. As will be appreciated, the channel shaped main body 302 can be yieldingly moved axially away from the outer end 344 of the connection tube 304 against the bins of the coil spring 350 and selectively rotated so that the radial legs 338 on the cylindrical extension 340 can be aligned with the slots 348 in the outer end 344 of the connection tube 304 to vary the angular orientation of the channel shaped main body 302. This, of course, allows the fisherman to position a fishing rod 316 at any desired angle.

Figure 21:
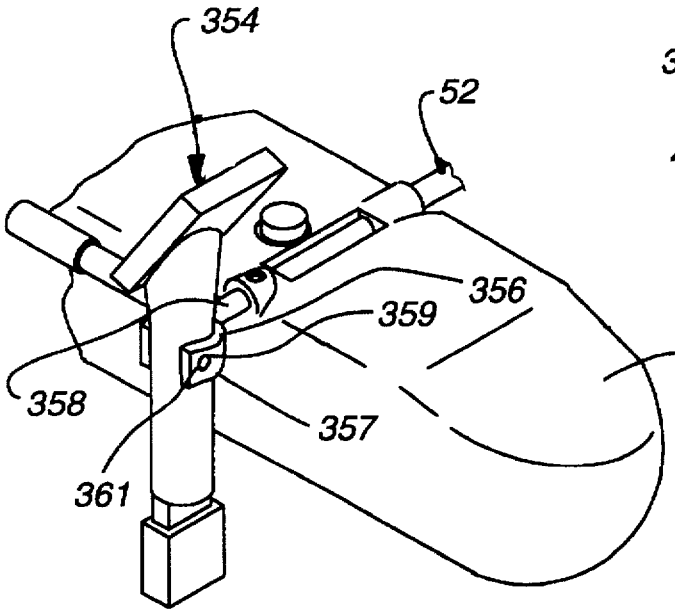
FIG. 21 is a fragmentary isometric showing an electronic fish finder attached to a rear portion of a pontoon of the vessel.

Another accessory that might be attached to the vessel 40 in one of the laterally opening passages 82 on a pontoon 50 is an electronic fish finder 354, as shown in FIG. 21. Such fish finders 354 are popular because they sonically locate fish and help improve a fisherman's efficiency. While the fish finders 354 may take different forms, for purposes of the present disclosure and by reference to FIG. 21, it will be seen that the fish finder 354 is suspended in a horizontally disposed clamp 356 adjacent to the side of a pontoon 50. The clamp 356 is substantially U-shaped, defining a pair of legs 357, one of which forms a threaded aperture 359 therethrough. A threaded fastener 361 (shown in said aperture 359) threadably fits in and through said correspondingly threaded aperture 359 to engage the fish finder 354 and releasably retain it in said clamp 356 in a conventional manner.

The clamp 356 is in turn secured to a connection tube 358 of the general type described previously in connection with the fishing rod holder 300 so that the connection tube 358 releasably supports the clamp 356 adjacent to the side of the pontoon 50 where the fish finder 354 can be disposed and supported by the clamp 356 for easy viewing by a user of the vessel 40.

Figure 22:
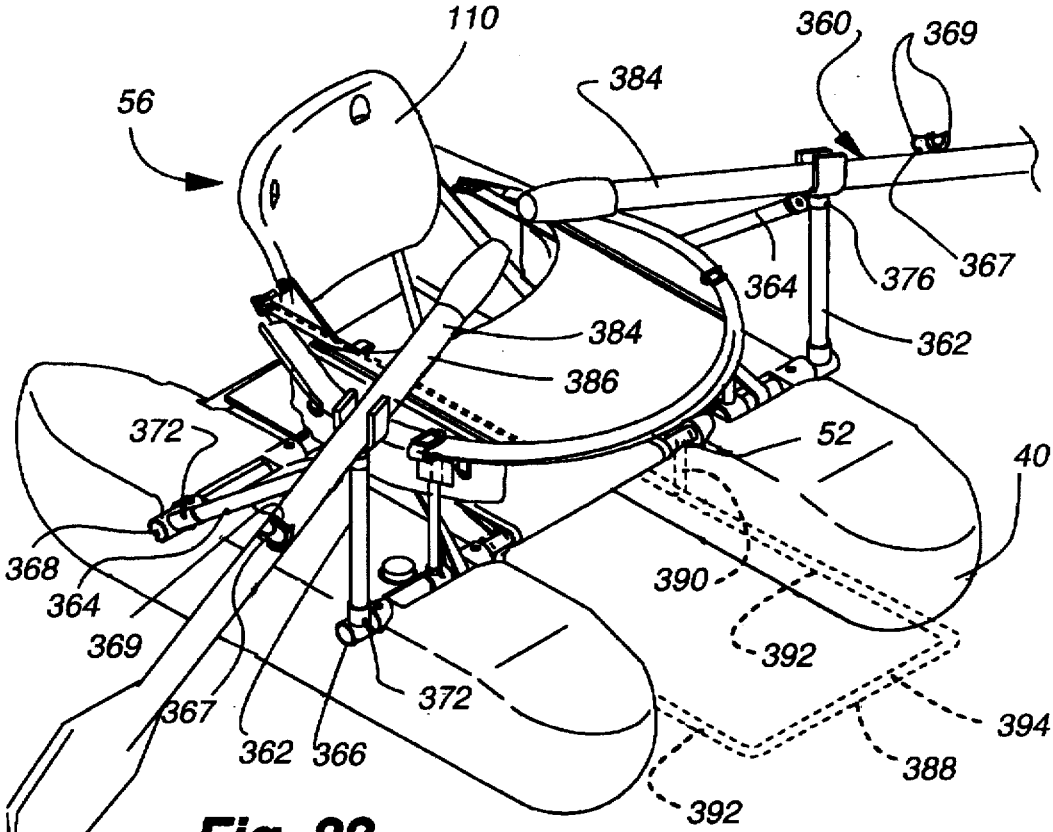
FIG. 22 is an isometric of the vessel with oar locks and oars attached to the vessel and including a foot rest to facilitate operation of the oars.
Figure 23:
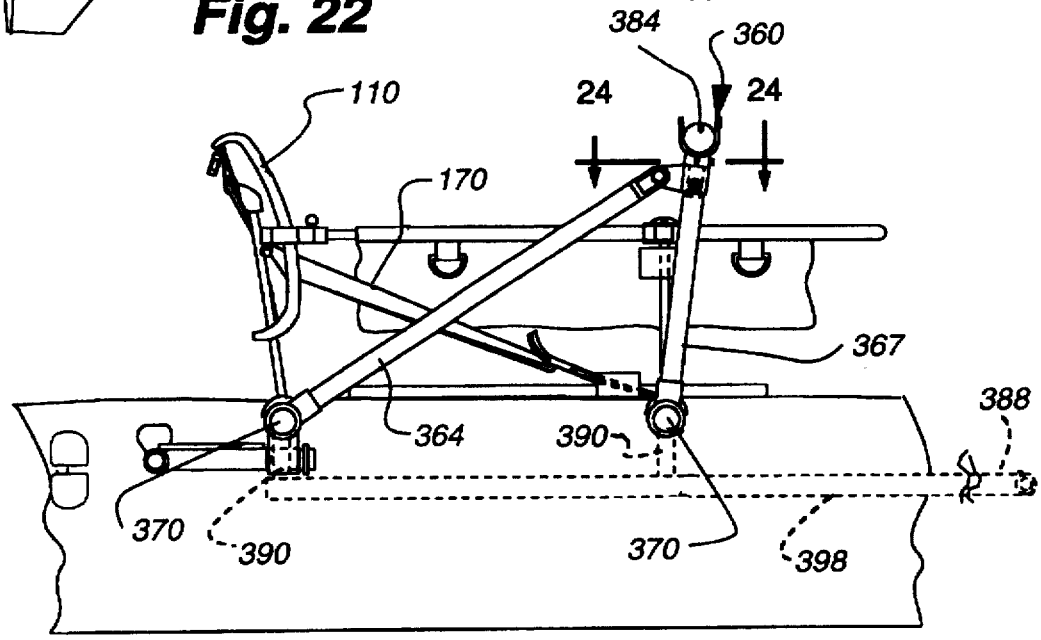
FIG. 23 is a left side elevation of the vessel with the oar locks mounted thereon but with the oars removed.
Figure 24:
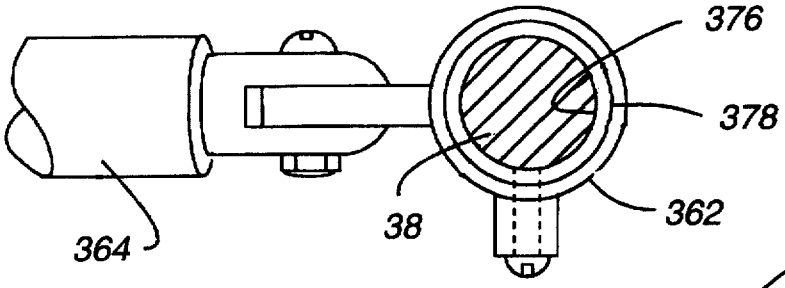
FIG. 24 is an enlarged fragmentary section taken along line 24—24 of FIG. 23.
Figure 25:
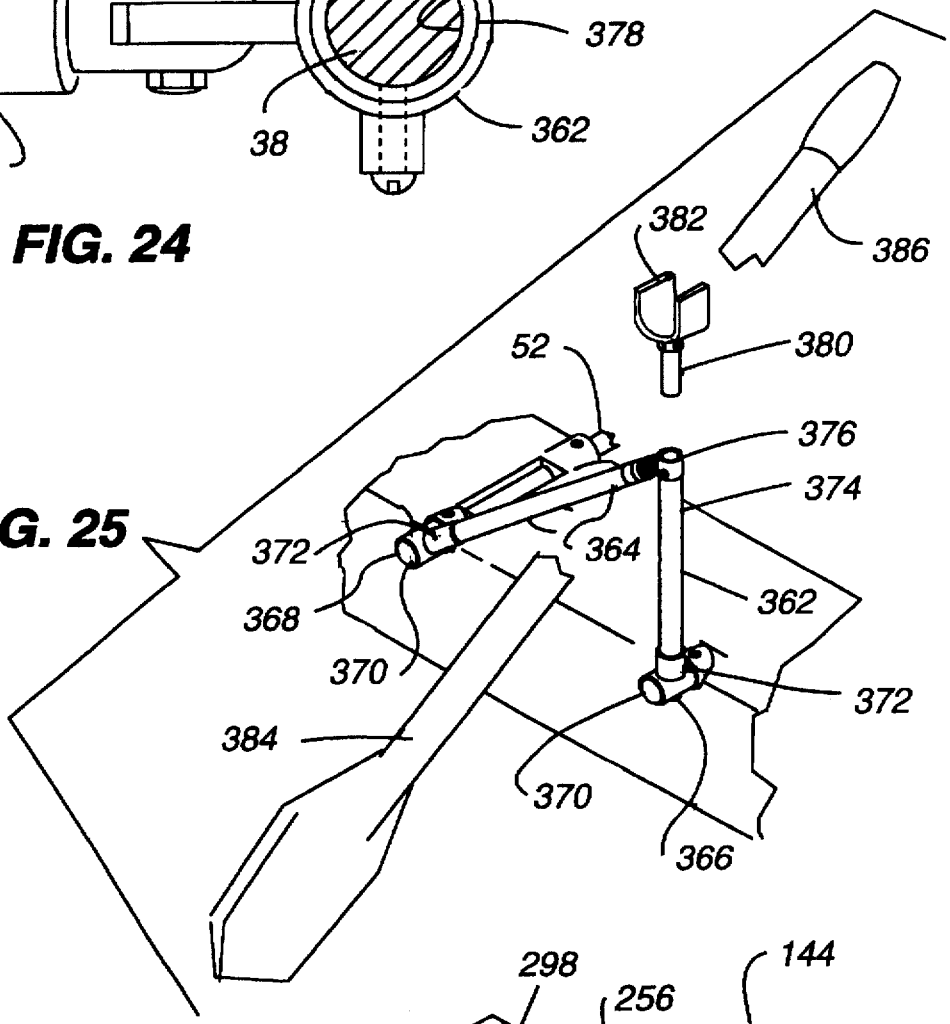
FIG. 25 is a fragmentary exploded isometric of a portion of a pontoon having the oar lock and an oar.

Another accessory that is easily connectable to the vessel 40 is an oar lock system 350 as is best seen in FIGS. 22–25. An oar lock system 360 is provided for each side of the vessel 40. The oar lock system 360 includes a pair of pivotally connected support arms 362, 364 having attached to their lower ends 366, 368 connection tubes 370 of the general type described previously in connection with the fishing rod holder 300 for releasable connection to a pontoon 50. Each connection tube 370 has a radially disposed cylindrical cup 372 that receives the end 366 or 368 of one of the support arms 362 or 364 with the end of the arm being secured in the cup 372. The rearward most support arm 362, which is supported in the rearward most cylindrical passage 82 on a pontoon 50, is shorter than the forwardmost support arm 364 and extends substantially vertically as best seen in FIG. 23. The upper end 374 of the rearward most support arm 362 has an axial recess 376 defining a bushing 378 to receive a pivotal support peg 380 on a U-shaped oar receptacle 382 adapted to conventionally receive an oar 384 as best seen in FIGS. 22 and 25. As in conventional oar lock systems, the U-shaped oar receptacle 382 and support peg 380 is readily removable from the support arm 362 and is pivotal therein so as to allow the oar 384 to pivot relative to the support arm 362 in rowing the vessel 40. As can be seen in FIG. 22, when the oars 384 are disposed on the oar locks, the handle end 386 of each oar 384 is disposed adjacent to the user of the vessel 40 for ease of operation.

Each oar 384 has mounted on it a channel member 367, such as found on the lower ends of support post 157. The channel member 367 is substantially cylindrical in configuration so as to define a pair of arcuate legs 369 that extend more than 180 degrees. The channel member 367 is made of a flexible material such as plastic or steel so that it can be easily snapped onto or off of the front 118 or rear 112 cross-frame member within the associated rectangular recess 74 to releasably hold the oar on the top of the pontoon 50 when not in use.

Since it is difficult to row without having a base against which the rower's feet can be braced, a footrest 388, seen best in FIGS. 22 and 23, is suspended from each cross frame member 52 in a conventional manner by hangers 390 that are secured to the cross frame members 52 and depend downwardly therefrom. Each hanger 390 is secured to a side leg 392 of a U-shaped rod 394 that has side leg portions 392 and a base portion 396 at the rear end 44 of the vessel 40. The side leg portions 392 are supported by the hangers and secured thereto so that the footrest 388 does not move relative to the cross frame members 52 and the base portion 396 of the U-shaped rod 394 is appropriately positioned and disposed for engagement by the operator's feet.

Figure 20:
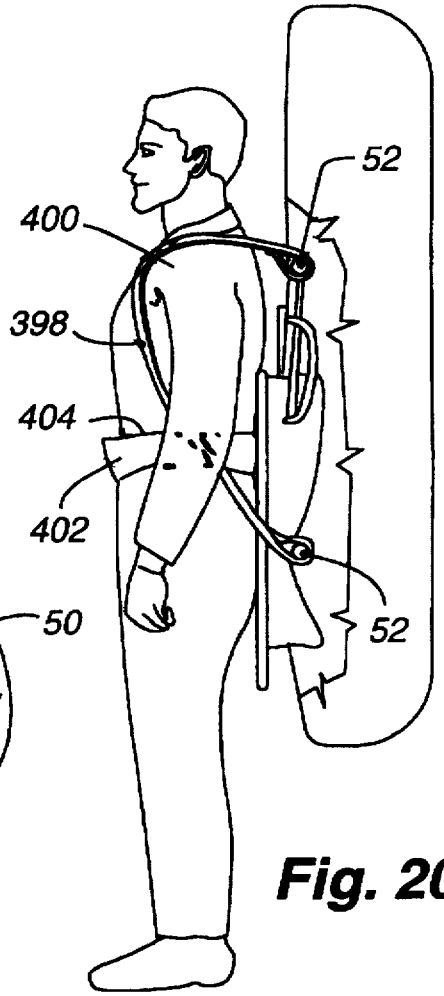
FIG. 20 is a diagrammatic side elevation showing the vessel of the present invention supported on the back of an individual.

Referring to FIG. 20, it will be seen that the vessel 40 can be easily carried in backpack fashion on a user by attaching shoulder straps 398 to the cross frame members 52 and passing those straps 398 around the shoulders 400 of a user. A waist strap 402 can also be interconnected with the shoulder straps 398 to secure the straps 398 to the waist 404 of the user. The shoulder straps 398 can be adjustable in length so as to provide for optimal placement of the vessel 40 on the user's back for ease of transportation.

With reference to FIGS. 2–8, it will be seen that the front end 406 of the vessel 40 can be provided with an auxiliary cross support bar 408 which extends parallel to the cross frame members 52 that interconnect the pontoons 50. Each end of the auxiliary cross support bar 408 is received and releasably retained in a notch 410 formed in the pontoons 50 so that the support bar 408 can be easily attached to or removed from the vessel 40. The support bar supports four longitudinally extending tubular elements 412 that in turn support a transverse tubular element 414. The outermost two of the longitudinal tubular elements 412 are adapted to be supported in receptacles 416 provided in hangers 418 suspendable from the front cross-frame member 118. The hangers 418 are in the form of blocks having perpendicular receptacles, (or holes) therein, with one hole for receiving a cross-frame member 52 and the other a longitudinal tubular element 414. A rectangular platform 420 can be secured to the auxiliary cross support bar 408 and tubular elements 414 to form a platform on which additional fishing gear or the like can be retained.

Preferably, the cross support bar 408 is an elongated cylindrical tube having opposing ends 422. The notches 410 formed in the pontoon 50 for receiving the ends 422 of the cross support bar 408 have a first partial cylindrical shape 424, with a dimension 426 greater than the bar 408, formed adjacent to and communicating with a second partial cylindrical shape 428. The second partial cylindrical shape 428 has a dimension 430 sufficient to receive the bar 408 in a secure but releasable manner, for instance, the second partial cylindrical shape 428 communicates with the adjacent first partial cylindrical shape 426 through an opening 432 having a dimension 434 just smaller than the bar 408. To releasably secure the ends 422 in the notches 410, the ends 422 are passed through the first partial cylindrical shape 424 and are pressed through the opening 432 to snap into the second partial cylindrical shape 428. The dimension 434 of the opening 432 is able to resiliently change to receive the bar 408 because of the inherent flexibility of the hull 50 material.

Figure 27:
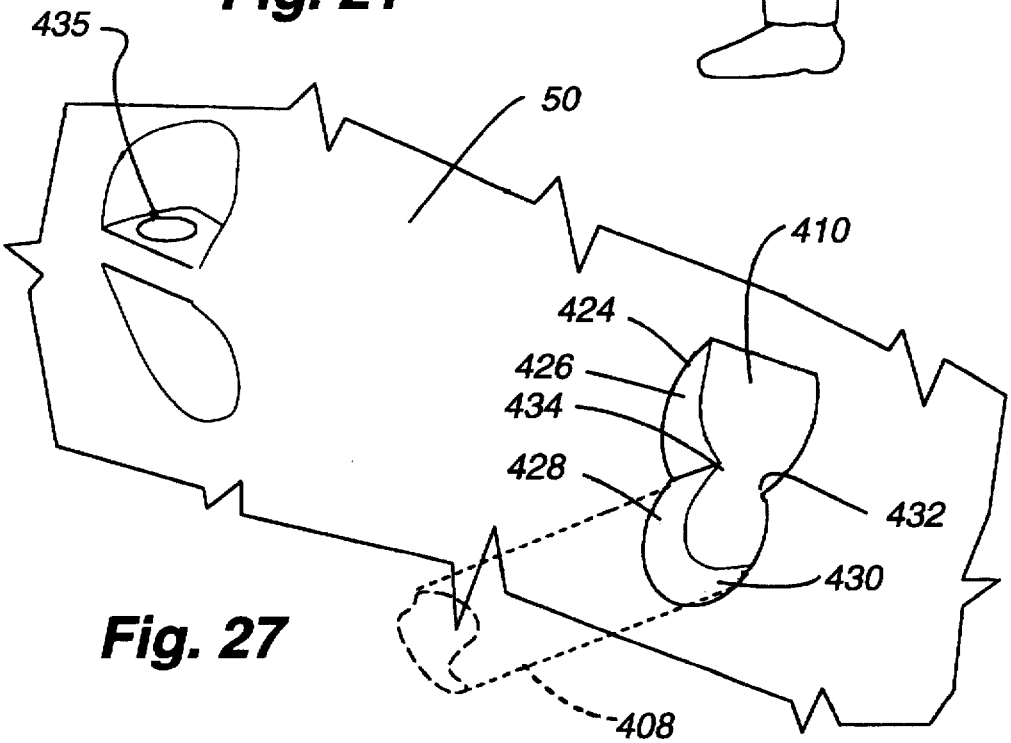
FIG. 27 is an enlarged fragmentary isometric showing a notch for receiving an auxiliary cross support bar, and an aperture for an anchor line or other tie-down utility.

An aperture 435 can be formed on either of the hulls 50 for use in securing an anchor line, or for any other suitable utility, as shown in FIGS. 3 and 27. The aperture 435 is formed from a wall of the hull, and is external to the hull 50, such that it does not communicate with the interior of the hull 50, which would cause a leak.

An ankle strap 436, as seen in FIGS. 3, 4 and 6 is suspended from the rear cross-frame member 112 by an elongated cable or cord 438 with the strap 436 being releasably securable to the ankle of the user of the vessel 40. In the event the user were to fall from the vessel 40, he would remain connected to the vessel 40 and could thereby grab hold of the vessel 40 for support.

As will also be appreciated by reference to FIGS. 4–6B, D-rings are suspended from the stripping apron frame 190 along lateral sides thereof so that additional storage compartments or pouches can be added to the vessel. Such pouches are not illustrated in the drawings even though it will be readily appreciated that such could be connected to the D-rings in a conventional manner.

Figure 19:
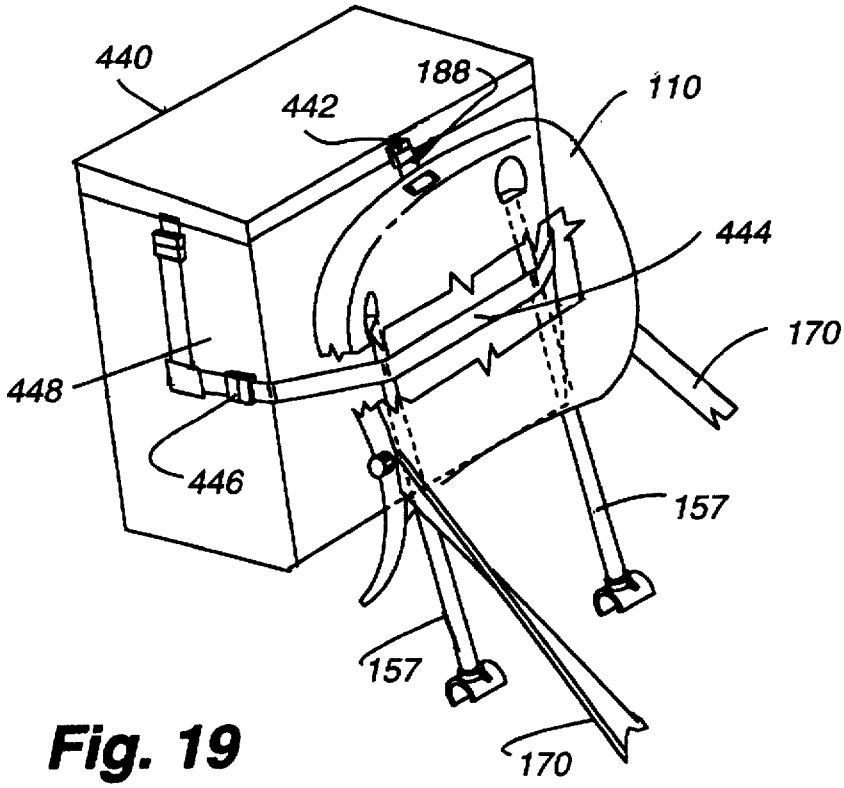
FIG. 19 is a fragmentary isometric showing a cooler attached to the seat back.

Another accessory item that is readily attachable to the vessel 40 is an insulated cooler 440, or other type of compartment, that can be suspended from the front surface 142 of the seat back 110. The cooler 440 would be provided with a male-type connector 442 that is complementary to the female connector provided along the top segment of the peripheral flange 144 of the seat back 110 as seen best in FIGS. 2, 17 and 19. A cinch strap 444 is additionally used to provide for a more secure attachment of the cooler 440 to the seat back 110. The cinch strap 444 is attached to the cooler at a conventional releasable connector 446, which is fixed to an outer surface 448 of the cooler 440. The cinch strap is fixed to the cooler in an identical fashion at a second position on the cooler (not shown). The cinch strap is adjustable, and acts to stabilize the cooler 440 by passing from one connection point on the cooler, between the posts 157 and the seat back 110, and back to the second connection point on the cooler, as shown in FIG. 19. Such a cooler 440 would thereby be easily accessible to the operator and could be used to retain food items or other such material.

As will be appreciated from the above, a vessel 40 has been described which not only provides a safe and dependable platform from which a fisherman or other sports enthusiast can be supported, but is designed in a manner so as to facilitate ready attachment and detachment of numerous accessory items. Not only can the accessory items be easily attached and detached from the vessel but each item is deployed in a position that is readily accessible to an operator of the vessel 40. The vessel 40 is held together by quick-release fasteners so that it can be easily assembled and disassembled or placed in a condition for transport on one's back.

Although the present invention has been described with a certain degree of particularity, it is understood that the disclosure has been made by way of example, and changes in detail or structure may be made without departing from the spirit of the invention as defined in the appended claims.

The invention claimed is:

1. A one man fishing vessel for supporting a user on a body of water, the vessel comprising:

a pair of pontoons, each defining a top wall having a width, an inner side wall and an outer side wall;

a recess formed in the top wall of each pontoon, the recess extending transversely across the width of the top wall between the inner side wall and the outer side wall;

an inner passage defined in the inner side wall of each pontoon adjacent to and communicating with said recess to form a first channel extending partially through each of said pontoons; and an elongated cross frame member defining opposing ends, each of the opposing ends being received in the passage on separate ones of the pontoons, and extending into said first channel, with a gap formed between the cross member and said top wall in said recess, to maintain the pontoons in a spaced relationship.

2. A one man fishing vessel as defined in claim 1, wherein each of said channels is exposed through the top wall of the pontoon adjacent to the recesses.

3. A one man fishing vessel as defined in claim 2, further comprising an outer passage defined in the outer side wall of each pontoon adjacent to and communicating with said recess to form a channel continuous through said pontoon from said inner side wall to said outer side wall.

4. A one man fishing vessel as defined in claim 3, wherein said cross frame member extends through the exposed portion of the channel and into said outer passage.

5. A one man fishing vessel as defined in claim 1, wherein each of said pontoons defines a second channel, and together with said first channel being spaced longitudinally on each of the pontoons to divide the length of each pontoon substantially into thirds; and further comprising a second elongated cross frame member defining opposing ends for placement between and insertion into said second channels.

6. A one man fishing vessel for supporting a user on a body of water, the vessel comprising:

a pair of pontoons, each defining a top wall having a width, an inner side wall and an outer side wall;

a recess formed in the top wall of each pontoon, the recess extending transversely across the width of the top wall between the inner side wall and the outer side wall;

an inner passage defined in the inner side wall of each pontoon adjacent to and communicating with said recess to form a first channel extending partially through each of said pontoons;

an elongated cross frame member defining opposing ends, each of the opposing ends being received in the passage on separate ones of the pontoons, and extending into said first channel to maintain the pontoons in a spaced relationship;

a first opening defined in said top wall of each pontoon communicative with said inner passage formed through said inner side wall;

a second opening defined in each end of said cross frame member, said opening being located at a position spaced inwardly from said ends of said cross frame members; and a spring-biased depressible button positioned in and extending from each of said second openings, said buttons depressible to be flush with the cross frame member, and extendable to protrude from said cross frame member, such that said buttons depress to allow insertion of the cross frame member into said channel, and extend into the respective said first opening in said top wall when aligned therewith to releasably position the cross frame member in said channel.

7. A one man fishing vessel for supporting a user on a body of water, the vessel comprising:

a pair of pontoons, each defining a top wall having a width, an inner side wall and an outer side wall;

a recess formed in the top wall of each pontoon, the recess extending transversely across the width of the top wall between the inner side wall and the outer side wall;

an inner passage defined in the inner side wall of each pontoon adjacent to and communicating with said recess to form a first channel extending partially through each of said pontoons;

an elongated cross frame member defining opposing ends, each of the opposing ends being received in the passage on separate ones of the pontoons, and extending into said first channel to maintain the pontoons in a spaced relationship;

an outer passage defined in the outer side wall of each pontoon adjacent to and communicating with said recess to form a channel continuous through said pontoon from said inner side wall to said outer side wall;

wherein each of said channels is exposed through the top wall of the pontoon adjacent to the recesses;

a second opening defined in said top wall of each pontoon communicative with said outer passage formed through said outer side wall;

a connection tube defining an inner end and an outer end for insertion into said outer passage, said connection tube defining an opening adjacent to said inner end; and a spring-biased depressible button positioned in and extending from the second opening in said connection tube, said button being depressible to be flush with the connection tube, and extendable to protrude from said connection tube, such that said button depresses to allow insertion of the connection tube into said outer passage, and extends into said second opening in said top wall when aligned therewith to releasably position the connection tube in said passage.

8. A vessel as defined in claim 7 further comprising:

an oarlock system attached to the outer end of said connection tube and extending upwardly of said pontoons; and an oar receptacle pivotally attached to each oarlock system to receive the oars.

9. A vessel as defined in claim 8, further comprising:

a U-shaped footrest attached to the rear cross frame member and extending downwardly therefrom for engagement by the user.

10. A one person fishing vessel for supporting a user on a body of water, the vessel comprising:

a pair of elongated pontoons, each having a front end and a rear end;

a front and rear cross frame member each defining opposite ends, the front cross frame member positioned between the pontoons generally adjacent to the front ends of said pontoons, and the rear cross frame member positioned between the pontoons generally adjacent to the rear end of said pontoons, to position the pontoons in a spaced apart relationship;

a seat bottom positioned between the front and rear cross frame members;

a seat back having a front surface and a back surface, the seat back being pivotally attached to said front cross frame member;

an elongated flexible strap having first and second terminal ends and a main body extending therebetween, said first and second ends being attached to the rear cross frame member and said main body extending forwardly to contact the front face of the seat back, wherein the seat back is supported in a generally upright position by said strap and pivots in a rearward direction from a generally upright position to a folded position extending adjacent to the seat bottom, and wherein the user is positionable in contact with said seat bottom and said seat back with the legs extending rearwardly over the rear cross frame member.

11. A fishing vessel as defined in claim 10, wherein:

said seat back comprises a main body member and a downwardly depending elongated support post attached to the main body member, the downwardly depending support post defining a laterally directed channel;

said laterally directed channel being positioned over said front cross frame member to receive said cross frame member in said laterally directed channel to form the pivotal attachment; and wherein said strap engages said main body member.

12. A fishing vessel as defined in claim 10, wherein:

said seat bottom comprises an elongated strip having first and second ends, said strip extending rearwardly from said front cross frame member to wrap around said rear cross frame member so as to form an upper layer, and extending forwardly back to said front cross frame member so as to form a lower layer.

13. A fishing vessel as defined in claim 12, further comprising:

a pocket defined in said seat bottom between said upper and lower layers and adjacent to said rear cross frame member; and a pad positioned in said pocket to provide cushioning.

14. A one person fishing vessel for supporting a user on a body of water, the vessel comprising:

a pair of elongated pontoons, each having a front end and a rear end;

a front and rear cross frame member each defining opposite ends, the front cross frame member positioned between the pontoons generally adjacent to the front ends of the pontoons, and the rear cross frame member positioned between the pontoons generally adjacent to the rear end of the pontoons, to position the pontoons in a spaced apart relationship and form a frame structure;

a seat attached between said front and rear cross frame members;

a platform having a main body with a peripheral edge and defining a top surface, the peripheral edge being pivotally attached to the seat to allow the platform to pivot between an upper position and a lower use position, wherein the platform in the lower use position is aligned substantially parallel to said pontoons for use by the user when positioned in said seat; and a support rod attached at a top end to the platform and releasably attached at a bottom end to the frame structure.

15. A vessel as defined in claim 14, wherein said top end of said support rod is attached to said peripheral edge.

16. A vessel as defined in claim 15, wherein said bottom edge of said support rod is realeasably attached to said rear cross frame member.

17. A vessel as defined in claim 14, wherein said substantial portion of said main body of said platform is selectively releasable from the peripheral edge.

18. A vessel as defined in claim 14, wherein said main body has a recess adjacent to the seat for positioning the user's body therein when said platform is in said use position.

19. A rodholder attached to a one-man fishing vessel for holding a fly-fishing type of rod having a handle and a reel having a base, said reel defining a diameter and being conventionally attached to the handle by the base, the base having a dimension smaller than the reel, comprising:

an elongated main body having inner and outer plate portions attached together by a bottom wall to define a channel, said channel adapted to receive the handle of said fishing rod;

an elongated connection tube attached to and extending outwardly from said inner plate to releasably connect said main body to said fishing vessel;

wherein said main body is attached to said connecting tube, and said main body being rotatable about the connection to the connecting tube;

said outer plate has a notch extending downwardly into said bottom wall; and said notch is adapted to receive the base of the reel, the diameter of the reel being larger than the dimension of the slot so as to capture the reel in the slot.

20. A rodholder attached to a one-man fishing vessel said rodholder having a spin-casting type reel, comprising:

an elongated main body having inner and outer plate portions attached together by a bottom wall to define a channel, said channel adapted to receive the handle of said fishing rod;

an elongated connection tube attached to and extending outwardly from said inner plate to releasably connect said main body to said fishing vessel;

wherein said main body is attached to said connecting tube, and said main body being rotatable about the connection to the connecting tube; and the inner plate having an inner wall; with the rodholder further comprising:

a pin removably connected to said inner wall and extending into said channel above said bottom wall, the handle of the rod being received in said channel between said pin and said bottom wall to capture the handle in the channel.

* * * * *